US007151447B1

(12) United States Patent
Willms et al.

(10) Patent No.: US 7,151,447 B1
(45) Date of Patent: Dec. 19, 2006

(54) DETECTION AND IDENTIFICATION OF THREATS HIDDEN INSIDE CARGO SHIPMENTS

(75) Inventors: Paul H. Willms, Everett, WA (US); James H. Stanley, Palo Alto, CA (US)

(73) Assignee: Erudite Holding LLC, Everett, WA (US)

( * ) Notice: Subject to any disclaimer, the term of this patent is extended or adjusted under 35 U.S.C. 154(b) by 9 days.

(21) Appl. No.: 10/931,730

(22) Filed: Aug. 31, 2004

(51) Int. Cl.
*G08B 21/00* (2006.01)

(52) U.S. Cl. ..... 340/540; 250/390.04; 376/159; 378/57

(58) Field of Classification Search ..... 340/540, 340/550, 545.6; 109/42; 250/390.04; 376/159; 378/57
See application file for complete search history.

(56) References Cited

U.S. PATENT DOCUMENTS 4,166,972 A * 9/1979 King et al. ..... 324/310
4,580,440 A * 4/1986 Reid et al. ..... 73/31.07
5,051,723 A 9/1991 Long et al.
5,076,993 A * 12/1991 Sawa et al. ..... 376/159
5,078,952 A * 1/1992 Gozani et al. ..... 376/159
5,278,418 A * 1/1994 Broadhurst ..... 250/390.04
5,524,133 A * 6/1996 Neale et al. ..... 378/57
5,557,108 A * 9/1996 Tumer ..... 250/390.04
5,818,054 A * 10/1998 Randers-Pehrson et al. ..... 250/390.04
5,818,897 A * 10/1998 Gordon ..... 378/57
5,838,759 A * 11/1998 Armistead ..... 378/57
5,930,314 A * 7/1999 Lanza ..... 376/159
6,946,300 B1 * 9/2005 Nguyen et al. ..... 436/110
6,959,248 B1 * 10/2005 Gard et al. ..... 702/22
2003/0136902 A1 * 7/2003 Nakashige et al. ..... 250/282
2004/0174259 A1 * 9/2004 Peel et al. ..... 340/539.26

* cited by examiner

*Primary Examiner*—Thomas Mullen
(74) *Attorney, Agent, or Firm*—Boris G. Tankhilevich

(57) ABSTRACT

A method for identifying at least one threat to the homeland security. Each threat is either hidden inside at least one cargo container before transit, or is placed inside at least one cargo container while in transit. Each threat while interacting with its surrounding generates a unique threat signature.
The method comprises the following steps: (A) detecting at least one threat signature; and (B) processing each detected threat signature to determine a likelihood of at least one threat to become a threat to the homeland security.

4 Claims, 6 Drawing Sheets

DETECTION AND IDENTIFICATION OF THREATS HIDDEN INSIDE CARGO SHIPMENTS

BACKGROUND OF THE INVENTION

1. Field of the Invention

The present invention relates to the field of threat detection and identification, and more specifically, to the field of detection and identification of threats hidden inside cargo shipments.

2. Discussion of the Prior Art

Guarding against illicit cargo trying to enter the country by land, sea or air shipping containers is a difficult problem. Each year more than 48 million loaded cargo containers move between the world's seaports. Six million loaded cargo containers arrive in the U.S. each year, but only 5 percent have their content visually inspected or x-rayed, opening the possibility that the terrorists could use them to smuggle in nuclear material, explosives, or even themselves.

What is needed is to develop a comprehensive detection and threat identification system that would allow one to detect a potential threat hidden inside a cargo shipment while in transit, and to determine the likelihood that the potential threat hidden inside the cargo shipment becomes a real threat to the homeland security.

SUMMARY OF THE INVENTION

To address the shortcomings of the available art, the present invention provides methods and means for detection and identification of threats hidden inside cargo shipments while in transit.

One aspect of the present invention is directed to a method for identifying at least one threat to the homeland security, whereas each threat either being hidden inside at least one cargo container before transit, or being placed inside at least one cargo container while in transit. Each threat while interacting with its surrounding generates a unique threat signature.

In one embodiment of the present invention, the method for identifying at least one threat to the homeland security comprises the following steps: (A) detecting at least one threat signature; and (B) processing each detected threat signature to determine a likelihood of at least one threat to become a threat to the homeland security.

In one embodiment of the present invention, the step (A) of detecting at least one threat signature further comprises the step (A1) of detecting each threat signature by detecting exchange of energy and/or matter of the threat with its surroundings.

More specifically, in one embodiment of the present invention, the step (A1) of detecting at least one threat signature by detecting an exchange of energy and/or matter of at least one threat with its surroundings further comprises the step (A1, 1) of detecting a form of exchanged energy selected from the group consisting of: {kinetic energy; and electromagnetic energy}. In this embodiment of the present invention, the kinetic energy is further selected from the group consisting of: {vibrational; thermal; and mechanical stored energy}; the vibrational energy is further selected from the group consisting of: {audible acoustic energy; and inaudible acoustic energy}; the thermal energy is further selected from the group consisting of: {conductive heat transfer; and convective heat transfer}; the mechanical stored energy is further selected from the group consisting of: {pressure stored energy; stress stored energy; tension tensile stored energy; and tension compressive stored energy}; and the electromagnetic energy (EM) is further selected from the group consisting of: {infrared (IR) electromagnetic energy (EM), visible (VIS) spectrum electromagnetic energy (EM); ultraviolet (UV) electromagnetic energy (EM); radio frequency (RF) electromagnetic energy (EM); X-ray electromagnetic energy (EM); and γ-ray electromagnetic energy (EM)}.

In one embodiment of the present invention, the step (A1) of detecting at least one threat signature by detecting exchange of energy and/or matter of at least one threat with its surroundings further comprises the step (A1, 2) of detecting an exchange of matter of the threat with its surroundings by detecting particles selected from the group consisting of: {subatomic particles; elements; molecules; and life forms}. In this embodiment of the present invention, the subatomic particles are further selected from the group consisting of: {alpha particles (helium nuclei); beta particles (electrons and positrons); and neutrons}; the elements are further selected from the group consisting of: {neutral atoms; ionized atoms; stable isotopes; and unstable isotopes}; the molecules are further selected from the group consisting of: {inorganic molecules; and organic molecules}; and the life forms are further selected from the group consisting of: {bacteria; viruses; and fungi}.

In one embodiment of the present invention, the step (A1) of detecting at least one threat signature by detecting an exchange of energy and/or matter of at least one threat with its surroundings further comprises the step (A1, 3) of detecting an exchange of energy and/or matter of the threat with its surroundings by detecting a live object selected from the group consisting of: {a human body; an animal body; a plant; and an insect}.

In one embodiment of the present invention, the step (A1) of detecting at least one threat signature by detecting exchange of energy and/or matter of at least one threat with its surroundings further comprises the step (A1, 4) of using a sensor configured to produce an output signal based on the detected exchange of energy and/or matter of at least one threat with its surroundings. In one embodiment of the present invention, the sensor comprises a sensor configured to produce an electrical output signal based on the detected exchange of energy and/or matter of at least one threat with its surroundings. In another embodiment of the present invention, the sensor comprises a sensor configured to produce an optical output signal based on the detected exchange of energy and/or matter of at least one threat with its surroundings. In an additional embodiment of the present invention, the sensor comprises a sensor configured to produce an acoustical output signal based on the detected exchange of energy and/or matter of at least one threat with its surroundings.

In one embodiment of the present invention, the step (A1) of detecting at least one threat signature by detecting exchange of energy and/or matter of at least one threat with its surroundings further comprises the step of using at least one sensor to substantially continuously monitor an interior environment of at least one cargo container to detect at least one threat signature.

In one embodiment of the present invention, the step (B) of processing each detected threat signature further comprises the following steps: (B1) selecting an array of statistically significant detected threat signatures; and (B2) substantially continuously processing the array of the selected statistically significant threat signatures in order to determine the likelihood of each threat.

In one embodiment of the present invention, the step (B1) of selecting the array of statistically significant detected threat signatures further comprises the following steps: (B1, 1) measuring a background threat signature distribution in a threat-free environment; (B1, 2) comparing each detected threat signature signal with the background threat signature distribution; and (B1, 3) if deviation of the detected threat signature signal from the background threat signature distribution is statistically significant, selecting the detected threat signature to be a part of the array of the statistically significant detected threat signatures for further processing.

In one embodiment of the present invention, the step (B2) of substantially continuously processing the array of the selected statistically significant threat signatures in order to determine the likelihood of each threat further comprises the following steps: (B2, 1) generating a statistically significant threat signal corresponding to each detected threat signature having the statistically significant deviation from the background threat signature distribution; (B2, 2) consulting a database of predetermined thresholds associated with a plurality of known threat signatures; (B2, 3) comparing each statistically significant threat signature signal with at least one predetermined threshold associated with the plurality of known threat signatures; (B2, 4) selecting each statistically significant threat signature signal that exceeds at least one predetermined threshold associated with the plurality of known threat signatures into an N-array of threat signatures, wherein the N-array includes an integer number N of statistically significant threat signature signals exceeding at least one predetermined threshold; (B2, 5) if the integer number N of statistically significant threat signature signals exceeding at least one predetermined threshold and selected into the N-array exceeds a predetermined number $N_{array_threshold}$; determining the likelihood of each threat generating at least one statistically significant threat signature signal exceeding at least one predetermined threshold and selected into the N-array; and (B2, 6) if the likelihood of at least one threat determined in the step (B2, 5) exceeds a predetermined threshold, identifying each threat as a threat to the homeland security.

Another aspect of the present invention is directed to an apparatus for identifying at least one threat to the homeland security, whereas each threat either is hidden inside at least one cargo container before transit, or is placed inside at least one cargo container while in transit, and whereas each threat while interacting with its surrounding generates a unique threat signature.

In one embodiment of the present invention, the apparatus comprises: (A) a means for detecting at least one threat signature; and (B) a means for processing each detected threat signature to determine a likelihood of at least one threat to become a threat to the homeland security.

In one embodiment of the present invention, the means (A) for detecting at least one threat signature further comprises (A1) a means for detecting each threat signature by detecting exchange of energy and/or matter of the threat with its surroundings.

More specifically, in one embodiment of the present invention, the means (A1) for detecting at least one threat signature by detecting an exchange of energy and/or matter of at least one threat with its surroundings further comprises (A1, 1) a means for detecting a form of exchanged energy selected from the group consisting of: {kinetic energy; and electromagnetic energy}. In this embodiment, the kinetic energy is further selected from the group consisting of: {vibrational; thermal; and mechanical stored energy}. In this embodiment, the vibrational energy is selected from the group consisting of: {audible acoustic energy; and inaudible acoustic energy}, and the thermal energy is selected from the group consisting of: {conductive heat transfer; and convective heat transfer}. In this embodiment, the mechanical stored energy is selected from the group consisting of: {pressure stored energy; stress stored energy; tension tensile stored energy; and tension compressive stored energy}, and the electromagnetic energy (EM) is selected from the group consisting of: {infrared (IR) electromagnetic energy (EM), visible (VIS) spectrum electromagnetic energy (EM); ultraviolet (UV) electromagnetic energy (EM); radio frequency (RF) electromagnetic energy (EM); X-ray electromagnetic energy (EM); and γ-ray electromagnetic energy (EM)}.

In one embodiment of the present invention, the means (A1) for detecting at least one threat signature by detecting an exchange of energy and/or matter of at least one threat with its surroundings comprises: (A1, 2) a kinetic energy detector configured to detect an exchange of kinetic energy between at least one threat with its surroundings. In this embodiment, the kinetic energy detector is selected from the group consisting of: {a vibrational energy detector; a thermal energy detector; and a mechanical stored energy detector}.

In another embodiment of the present invention, the means (A1) for detecting at least one threat signature by detecting an exchange of energy and/or matter of at least one threat with its surroundings comprises: (A1, 3) a vibrational energy detector configured to detect an exchange of vibrational energy between at least one threat with its surroundings. In this embodiment, the vibrational energy detector is selected from the group consisting of: {an audible acoustic energy detector; and inaudible acoustic energy detector}.

In one more embodiment of the present invention, the means (A1) for detecting at least one threat signature by detecting an exchange of energy and/or matter of at least one threat with its surroundings comprises: (A1, 4) a thermal energy detector configured to detect an exchange of thermal energy between at least one threat with its surroundings. In this embodiment, the thermal energy detector is selected from the group consisting of: {a conductive heat transfer detector; and a convective heat transfer detector}.

In an additional embodiment of the present invention, the means (A1) for detecting at least one threat signature by detecting an exchange of energy and/or matter of at least one threat with its surroundings comprises: (A1, 5) a mechanical stored energy detector configured to detect an exchange of mechanical stored energy between at least one threat with its surroundings. In this embodiment, the mechanical stored energy detector is selected from the group consisting of: {a pressure stored energy detector; a stress stored energy detector; a tension tensile stored energy detector; and a tension compressive stored energy detector}.

Yet, in one more embodiment of the present invention, the means (A1) for detecting at least one threat signature by detecting an exchange of energy and/or matter of at least one threat with its surroundings comprises: (A1, 6) an electromagnetic energy (EM) detector configured to detect an exchange of electromagnetic energy between at least one threat with its surroundings. In this embodiment, the electromagnetic energy (EM) detector is selected from the group consisting of: {an infrared (IR) electromagnetic energy (EM) detector, a visible (VIS) spectrum electromagnetic energy (EM) detector; an ultraviolet (UV) electromagnetic energy (EM) detector; a radio frequency (RF) electromagnetic energy (EM) detector; an X-ray electromagnetic energy (EM) detector; and a γ-ray electromagnetic energy (EM) detector}.

In one embodiment of the present invention, the means (A1) for detecting at least one threat signature by detecting an exchange of energy and/or matter of at least one threat with its surroundings further comprises: (A1, 7) a means for detecting an exchange of matter of the threat with its surroundings by detecting particles selected from the group consisting of: {subatomic particles; elements; molecules; and life forms}. In this embodiment, the subatomic particles are further selected from the group consisting of: {alpha particles (helium nuclei); beta particles (electrons and positrons); and neutrons}. In this embodiment, the elements are further selected from the group consisting of: {neutral atoms; ionized atoms; stable isotopes; and unstable isotopes}. In this embodiment, the molecules are further selected from the group consisting of: {inorganic molecules; and organic molecules}. In this embodiment, the life forms are further selected from the group consisting of: {bacteria; viruses; and fungi}.

In one embodiment of the present invention, the means (A1) for detecting at least one threat signature by detecting an exchange of energy and/or matter of at least one threat with its surroundings further comprises: (A1, 8) a subatomic particle detector configured to detect an exchange of matter of the threat with its surroundings by detecting particles selected from the group consisting of: {subatomic particles; elements; molecules; and life forms}. In this embodiment, the subatomic particle detector is selected from the group consisting of: {an alpha particle detector; a beta particle detector; and a neutron detector}.

In another embodiment of the present invention, the means (A1) for detecting at least one threat signature by detecting an exchange of energy and/or matter of at least one threat with its surroundings further comprises: (A1, 9) an element detector configured to detect an exchange of matter of one threat with its surroundings by detecting elements selected from the group consisting of: {neutral atoms; ionized atoms; stable isotopes; and unstable isotopes}. In this embodiment, the element detector is selected from the group consisting of: {a neutral atom detector; an ionized atom detector; a stable isotope detector; and an unstable isotope detector}.

In one more embodiment of the present invention, the means (A1) for detecting at least one threat signature by detecting an exchange of energy and/or matter of at least one threat with its surroundings further comprises: (A1, 10) a molecular detector configured to detect an exchange of matter of the threat with its surroundings by detecting molecules selected from the group consisting of: {inorganic molecules; and organic molecules}. In this embodiment, the molecular detector is selected from the group consisting of: {an inorganic molecular detector; and an organic molecular detector}.

In an additional embodiment of the present invention, the means (A1) for detecting at least one threat signature by detecting an exchange of energy and/or matter of at least one threat with its surroundings further comprises: (A1, 11) a life form detector configured to detect an exchange of matter of the threat with its surroundings by detecting life forms selected from the group consisting of: {bacteria; viruses; and fungi}. In this embodiment, the life form detector is selected from the group consisting of: {a bacteria detector; a virus detector; and a fungi detector}.

Yet, in one more embodiment of the present invention, the means (A1) for detecting at least one threat signature by detecting an exchange of energy and/or matter of at least one threat with its surroundings further comprises: (A1, 12) a life object detector configured to detect an exchange of matter of the threat with its surroundings by detecting a live object selected from the group consisting of: {a human body; an animal body; a plant; and an insect}.

In one embodiment of the present invention, the means (A1) for detecting at least one threat signature by detecting an exchange of energy and/or matter of at least one threat with its surroundings further comprises: (A1, 13) a sensor configured to produce an output signal based on the detected exchange of energy and/or matter of at least one threat with its surroundings.

In one embodiment of the present invention, the means (A1) for detecting at least one threat signature by detecting an exchange of energy and/or matter of at least one threat with its surroundings further comprises: (A1, 14) an electrical sensor configured to produce an output electrical signal based on the detected exchange of energy and/or matter of at least one threat with its surroundings. In another embodiment of the present invention, the means (A1) for detecting at least one threat signature by detecting an exchange of energy and/or matter of at least one threat with its surroundings further comprises: (A1, 15) an optical sensor configured to produce an output optical signal based on the detected exchange of energy and/or matter of at least one threat with its surroundings. In one more embodiment of the present invention, the means (A1) for detecting at least one threat signature by detecting an exchange of energy and/or matter of at least one threat with its surroundings further comprises: (A1, 16) an acoustical sensor configured to produce an output acoustical signal based on the detected exchange of energy and/or matter of at least one threat with its surroundings.

In one embodiment of the present invention, the means (B) for processing each detected threat signature further comprises: (B1) a means for selecting an array of the statistically significant detected threat signatures; and (B2) a means for substantially continuously processing the array of the selected statistically significant threat signatures in order to determine the likelihood of each threat.

In one embodiment of the present invention, the means (B1) for selecting the array of the statistically significant detected threat signatures further comprises: (B1, 1) a means for measuring a background threat signature distribution in a threat-free environment; (B1, 2) a means for comparing each detected threat signature signal with the background threat signature distribution; and (B1, 3) a means for selecting the detected threat signature to be a part of the array of the selected statistically significant threat signatures for further processing, if deviation of the selected threat signature signal from the background threat signature distribution is statistically significant.

In one embodiment of the present invention, the means for substantially continuously processing the array of the selected statistically significant threat signatures in order to determine the likelihood of each threat further comprises: (B2, 1) a means for generating a statistically significant threat signal corresponding to each detected threat signature having the statistically significant deviation from the background threat signature distribution; (B2, 2) a means for consulting a database of predetermined thresholds associated with a plurality of known threat signatures; (B2, 3) a means for comparing each statistically significant threat signature signal with at least one predetermined threshold associated with the plurality of known threat signatures; (B2, 4) a means for selecting each statistically significant threat signature signal that exceeds at least one predetermined threshold associated with the plurality of known threat signatures into an N-array of threat signatures; (B2, 5)

a means for determining the likelihood of each threat generating at least one statistically significant threat signature signal exceeding at least one predetermined threshold; and (B2, 6) a means for identifying each threat to the homeland security.

BRIEF DESCRIPTION OF DRAWINGS

The aforementioned advantages of the present invention as well as additional advantages thereof will be more clearly understood hereinafter as a result of a detailed description of a preferred embodiment of the invention when taken in conjunction with the following drawings.

DETAILED DESCRIPTION OF THE PREFERRED AND ALTERNATIVE EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
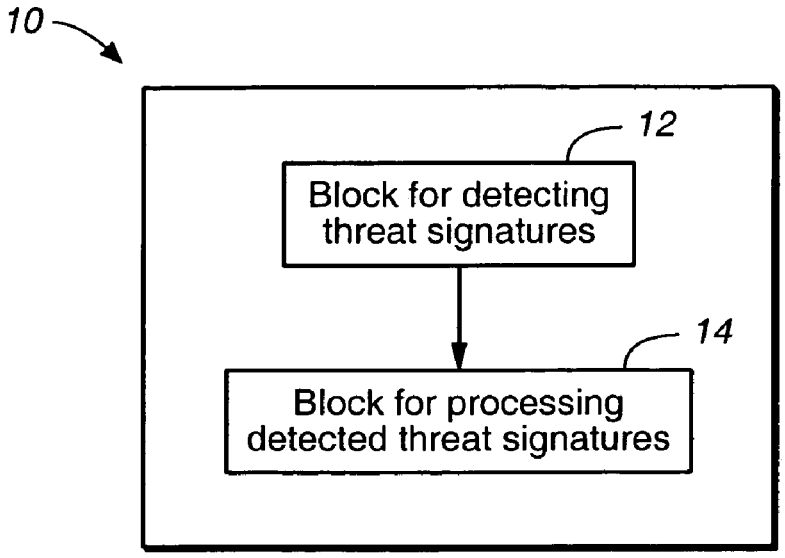
FIG. 1 illustrates the apparatus of the present invention comprising: (A) a block for detecting at least one threat signature, and (B) a block for processing each detected threat signature to determine a likelihood of at least one threat to become a threat to the homeland security.

In one embodiment, FIG. 1 depicts the apparatus of the present invention 10 comprising: (A) a block 12 for detecting at least one threat signature; and (B) a block 14 for processing each detected threat signature to determine a likelihood of at least one threat to become a threat to the homeland security.

As defined herein, threats are items that are not included on the manifest, because the security system was compromised at some point prior to sealing the container. While this is a necessary condition, it is not a sufficient one for illicit contents to be classified as a threat. To be a threat, undeclared cargo should also represent a significant hazard to the homeland. A package of cocaine would constitute illegal cargo but not a security threat.

It is assumed that each threat is either hidden inside at least one cargo container before transit, or is placed inside at least one cargo container while in transit. It is also assumed that each threat while interacting with its surrounding generates a unique threat signature.

Indeed, a threat hidden inside a cargo container should of necessity interact with its environment. These interactions will be collectively referred to here as signatures. By detecting these exchanges, it is possible to identify a threat. Please, see full discussion below.

The same argument applies to protecting the integrity of a container. All attempts to insert something into a sealed cargo container should of necessity interact with the container. Thus, the ability to guard against a breach of container integrity is equivalent to the ability to detect exchanges of mass and/or energy between the intruder and the container. Please, see full discussion below.

Whether or not it is practical to detect these interactions is not an issue. In fact, the present disclosure assumes that the ability to identify threat signatures is currently less than perfect but will improve over time as technology evolves. Until such time, the comparison of multiple signals to maximize detection and minimize false alarms is an essential part of the strategic vision.

The same argument applies to protecting the integrity of a container. All attempts to insert something into a sealed cargo container should of necessity interact with the container. Thus, the ability to guard against a breach of container integrity is equivalent to the ability to detect exchanges of mass and/or energy between the intruder and the container.

Like highway trailers, containers come in many variations. The configurations include simple boxes with end door only and no insulation; insulated; insulated and equipped with temperature regulating equipment (heating/cooling). Temperature control equipment can be internally or externally mounted and use either on-board or external energy sources. Some special-purpose containers have side as well as end doors. It is also possible for containers to have top doors/hatches. Some containers have adjustable vents for air circulation, but without any mechanical heating/cooling equipment.

There are two special variations of containers: a tank container and a flat rack. The tank container comprises a cylindrical tank mounted within a rectangular steel framework and includes standard container dimensions (usually 20 or 28 ft). These tanks are intended for use for either liquids or bulk materials. (Because of the weight of liquids and most bulk cargoes, larger sizes are not used for tank containers.)

Flat racks are open-sided platforms, usually with end bulkheads, with the same footprint as basic containers. A collapsible flat rack is one where the end bulkheads can be folded down when the flat rack is stored or shipped empty. Flat racks are used for heavy machinery and are typically carried below decks on ocean legs of their movement. Containers that are described as 20 ft are normally actually 19 ft 11 in. This simplifies getting two 20 ft containers into the same space as a 40 ft container. There are similar variations in the actual sizes of many other types of containers. The quoted sizes are "nominal" sizes.

The framework of containers is normally steel. The exterior sheathing may be either steel or aluminum. Interior sheathing may consist of plywood or composite materials. In 1995 testing began for containers made of space-age composites. Though more expensive than metal-sheathed containers, the composite-sided containers are lighter and are expected to have a longer useful life than metal containers.

The use of large container ships capable of carrying large numbers of containers and being loaded and unloaded quickly at special container ports has drastically changed the movement of ocean cargo over a relatively short time. Though most container traffic is on the super container ships between major ports, even most smaller vessels now have provisions for carrying some containers on deck.

On the larger container vessels, the containers are located above the deck, as well as below the deck. The container cranes used in major ports to quickly load and unload containers are also capable of lifting off the deck plates of these ships for access to containers located below decks. The containers are usually stacked on ships in an X-pattern. Not all container ships are equipped to carry all sizes of containers. Super container ships are typically capable of carrying at least 48/45/40/20 ft containers. Smaller container ships, particularly ones which also carry non-containerized cargo, sometimes may only be able to handle the more common 40 and 20 ft units. Container capacities of ships are given in TEUs (twenty-foot equivalent units) or FEUs (forty-foot equivalent units). In other words, the TEU number is the total number of 20 ft containers of the standard height the ship is theoretically capable of carrying, though not all parts of the ship may actually be set up for holding 20 ft containers.

Due to so-called vessel-sharing agreements, where carriers pool equipment on a given route, one may find containers of one carrier aboard the vessel of another. Also, in cases where no single carrier serves the entire route of a container's travel, a container may also be interchanged from one ocean carrier to another. Containers are also often carried inland on barges on navigable rivers. The container standards allow containers to be handled by both very sophisticated container handling equipment and by very simple equipment. In essence, as long as one has a crane capable of lifting the weight of the loaded container, one can handle the container. In this case, cables with hooks are attached to the four top lift points, coming together at the main hook of the crane. Usually one or more lines are attached to the lower connection points to keep the container from twisting and to manually maneuver it into place at its new location. This technique is still used at smaller third-world ports where labor is more readily available than complex equipment or when ship-board cranes of smaller vessels have to be used to load and unload containers at smaller ports. Some mid-range container ships have their own loading and unloading equipment that functions similar to dock-side container cranes. These ships have lifting equipment that runs on overhead rails that extend far enough out over the sides of the ship to be able to lift the containers on and off the dock. This type of equipment is expensive to maintain, however, because, being located atop the ship, the equipment is exposed to the elements while the ship is at sea. So, most ship-to-shore transfer of containers involving large container ships and large ports is done with large land-based container cranes. These cranes lock onto the containers with a piece called a spreader. The spreader can adjust to different lift-point spreads. These cranes allow very precise placement of containers and can also verify the actual weight of each container as it is being lifted (via equipment in the spreader—with this data being sent back through one of the control cables attached to the spreader).

Containers are not normally transferred directly from a ship to a railcar, though there are some exceptions. The reason for this is that the most logical sequence for unloading a container ship (which has to remain in balance) may not match with the most logical sequence for loading a double-stack train. Additionally, containers from one ship may go on different trains to different destinations. Similarly, trains reaching a port may carry containers destined for different locations served by different ships, or which, at the very least, need to be loaded on a ship in a very specific sequence. So, there is usually a rail intermodal terminal close to the actual dock, with transfers being made on a road chassis. Containers may be stored in transit on the chassis or stacked several-high. The equipment at a port-adjacent intermodal rail facility is almost the same as at inland intermodal facilities where containers and trailers are moved on and off intermodal trains. The equipment falls into two general categories-straddle cranes which span one or more tracks and paved areas for chassis placement and side-loaders. Straddle cranes may operate on fixed rails or with large rubber tires.

Referring still to FIG. 1, as was stated above, the apparatus 10 of the present invention provides methods and means for detection and identification of threats hidden inside cargo shipments while in transit. There are several potential risks associated with the container cargo shipments. The present invention addresses two main and separate risks. The first risk is associated with having an undeclared threat sealed inside a cargo container. This risk, by definition, assumes that a security failure has unknowingly occurred earlier in the shipping system. This could happen, for example, if a weapon of mass destruction (WMD) were successfully smuggled into a cargo container during the loading process.

The second risk is that of having the integrity of a container violated at some point while in transit, that is after it has been formally sealed but before it has been formally opened. This could happen, for example, if a WMD were successfully inserted into a container somewhere on the high seas. If these two risks could be eliminated with 100% certainty, no illicit cargo could enter the country via a shipping container, except via a rogue, where rogue is defined as an undeclared cargo container that has been inserted into the transit network somewhere between shipping nodes.

Referring still to FIG. 1, in one embodiment of the present invention, the block 12 for detecting at least one threat signature further comprises (A1) a block for detecting each threat signature by detecting exchange of energy and/or matter of the threat with its surroundings.

Figure 2:
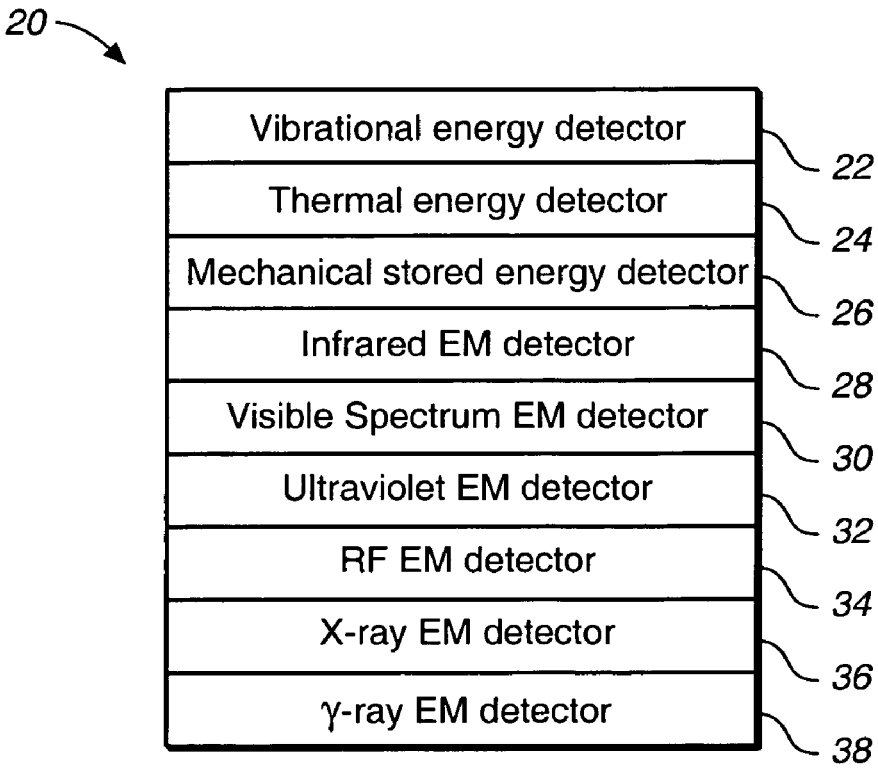
FIG. 2 depicts the block for detecting a form of exchanged energy selected from the group consisting of: {kinetic energy; and electromagnetic energy} and comprises: a vibrational energy detector, a thermal energy detector, a mechanical stored energy detector, an infrared (IR) electromagnetic energy (EM) detector, a visible (VIS) spectrum electromagnetic energy (EM) detector, an ultraviolet (UV) electromagnetic energy (EM) detector, a radio frequency (RF) electromagnetic energy (EM) detector, an X-ray electromagnetic energy (EM) detector, and a γ-ray electromagnetic energy (EM) detector.

In one embodiment of the present invention, as shown in diagram 20 of FIG. 2, the block (A1) for detecting at least one threat signature by detecting an exchange of energy and/or matter of at least one threat with its surroundings further comprises a vibrational energy detector 22, a thermal energy detector 24, a mechanical stored energy detector 26, an infrared (IR) electromagnetic energy (EM) detector 28, a visible (VIS) spectrum electromagnetic energy (EM) detector 30, an ultraviolet (UV) electromagnetic energy (EM) detector 32, a radio frequency (RF) electromagnetic energy (EM) detector 34, an X-ray electromagnetic energy (EM) detector 36, and a γ-ray electromagnetic energy (EM) detector 38.

More specifically, in one embodiment of the present invention, the vibrational energy detector 22 further comprises an audible acoustic energy detector (not shown).

Acoustic emission (AE) is a nondestructive testing (NDT) technique which allows one to predict when a material under stress will fail. Every material "talks" under stress; audible acoustic emission signals occur when paper is torn, glass is broken or wood is cracked. Leaks also emit AE, but usually well above the human-hearing range and long before a physical defect is seen. Acoustic emission is the ideal preventive maintenance technique to monitor and detect leakages for applications requiring non-intrusive testing. The AE is a standard technique for leak location in pipelines. However, the AE can be used also for the purposes of the present invention to detect a threat signatures associated with a threat hidden inside a container while in transit and generating an audible acoustic energy.

More specifically, an Acoustic Sensor (AS) can be mounted on the exterior surface of a container detects leak-associated sounds which are generated by the leak source and in turn transmitted through the container structure. The leak detector (electronic instrument) amplifies the acoustical signal, filters it, and then displays the level on the front panel meter. The acoustic energy propagating from the lead source decreases in amplitude as a function of distance from the source. This is known as signal attenuation. Obtaining the attenuation characteristics of a cargo container and detecting the leak noise at several locations allows one to exactly locate the leak inside the container.

Physical Acoustics Corp. (PAC) located at 195 Clarksville Road, Princeton Jct, N.J. 08550, USA, designs and manufactures acoustic emission sensors and acoustic emission measurement instruments under a quality program which is certified to ISO-9001 standards.

AE sensors are vital links between the test structures and the analysis instrumentation, and their performance is critical to the success of every test. AE sensors are available from PAC in various sizes, shapes, frequency and temperature ranges, and packaging styles n order to meet the diverse needs of the application and environment.

The latest digital electronics enhances the performance of an Acoustic Sensor. Data storage locks in the visual and audio indicators of changing conditions and indications of leaks. This allows one to maximize the inspection capability while eliminating any errors in logging test results. Computer interface downloads stores readings for permanent record, archiving or further analysis. High sensitivity over a broadband of frequencies is ideal for diverse applications of leaks in a variety of container structures.

General Purpose sensors are designed to be low cost, high sensitivity, resonant type sensors, medium size, medium temperature range, and are used in most AE applications. Due to the difference in cost between general purpose sensors and all other sensor families, one would move away from general purpose sensors only if there is a need for a different size or shape sensor due to space limitations, need for a different frequency range (e.g. wideband), different temperature (e.g. high or low temperature) or environmental (e.g. waterproof) requirement. As a rule, one should always look towards selection of a general purpose AE sensor first, since it has the best price and performance of all the rest of the sensor families.

Referring still to FIG. 2, in one embodiment of the present invention, the vibrational energy detector 22 further comprises an inaudible acoustic energy detector (not shown).

The EXTRONIC ELEKTRONIK AB located at Fräsarvägen 8, S-142 50 SKOGÅS, SWEDEN, manufactures an infra sound inaudible acoustic energy detector AD-300. AD-300 is an acoustic microprocessor controlled detector that senses only very low, inaudible frequencies (infra sound 0–3 Hz). Such low frequencies occur, for example, when doors open, or when an intruder tries to enter the container, and they are detected by AD-300. This detector is "deaf" to all other sounds. The integrated changeover relay becomes energized when sound is detected. The relay remains energized during the time set on the integrated timer. Switching on is initiated by the inaudible infra-wave that is generated by an opening of a container.

Referring still to FIG. 2, in one more embodiment of the present invention, the block 20 for detecting at least one threat signature by detecting an exchange of energy and/or matter of at least one threat with its surroundings comprises a thermal energy detector 24 configured to detect an exchange of thermal energy between at least one threat with its surroundings. In one embodiment, the thermal energy detector comprises a conductive heat transfer detector. In another embodiment, the thermal energy detector comprises a convective heat transfer detector.

Heat is a form of energy that is transferred from one object to another, or from one part of an object to another part, due to a difference in temperature between the two. Heat always flows from hotter objects to colder. There are three mechanisms for heat transfer: 1) Conduction, 2) Convection, and 3) Radiation.

The heat conduction is the flow of heat energy through solid bodies. This heat flow occurs when two solid bodies of differing temperatures come into physical contact, or when one solid body experiences a temperature difference from one area to another. For the purposes of the present invention, this form of energy transfer between a threat and its surroundings may occur in a container filled with solid objects.

The heat convection is the transfer of heat through the movement of a liquid or gas such as water or air. A good example is the uniform heating of water in a tea kettle. Water heated at the bottom of the kettle rises, allowing cooler water to move to the bottom, where it is then heated. This continuous stirring action brings the whole body of water to a near uniform temperature. For the purposes of the present invention, this form of energy transfer between a threat and its surroundings may occur in a container filled (at least partially) with liquids.

Radiation is the transfer of heat energy via the electromagnetic radiation emitted by an object. This radiation is emitted by objects in all directions without need of a solid or fluid to transfer the heat. The heat felt around a dying campfire from the glowing embers is felt primarily as a result of thermal radiation.

A variety of methods and instruments can be used to determine thermal conductivity. Instruments that use the steady-state conditions described in the Fourier equation are primarily suitable for analyzing materials with low or average thermal conductivities at moderate temperatures. Instruments based on dynamic (transient) methods, such as the hot-wire or flash diffusivity methods, are used to characterize materials with a high thermal conductivity and/or for measurements at high temperatures.

In heat flow meters, a square sample with a well-defined thickness (usually 30 cm in length and width and 10 cm thick) is inserted between two plates, and a fixed temperature gradient is established. The heat flow through the sample is measured with calibrated heat flow sensors that are in contact with the sample at the plate interface. The thermal conductivity is determined by measuring the thickness, the temperature gradient and the heat flow through the sample. Samples can be up to 10 cm thick with a length and width between 30 and 60 cm. This method of determining the thermal conductivity can be used to successfully test materials with thermal conductivities between 0.005 and 0.5 W/mK (Watt per meter per Kelvin). Depending on the type of instrument used, measurements between −20 C and 100 C are possible. Advantages of this method include easy handling, accurate test results and fast measurements, while disadvantages include its limited temperature and measurement range. The heat flow meter NETZSCH HFM 436 Lambda manufactured by NETZSCH Instruments, Inc., 37 North Ave., Burlington, Mass. 01803, can be used to analyze materials with low thermal conductivities and average thermal conductivities at moderate temperatures.

For larger samples that require a higher measurement range, guarded heat flow meters can be used. The measurement principle is nearly the same as with regular heat flow meters, but the test section is surrounded by a guard heater, resulting in higher measurement temperatures. Additionally, higher thermal conductivities can be measured with this method. The hot-plate or guarded hot-plate apparatus uses an operating principle similar to the heat flow meter with hot and cold plates. The heat source is positioned in the center between two samples of the same material. Two samples are used to guarantee symmetrical heat flow upward and downward, as well as complete absorption of the heater's energy by the test samples. A well-defined power is put into the hot plate during the test. The measurement temperatures and temperature gradient are adjusted between the heat source and the auxiliary plates by adjusting the power input into the auxiliary heaters. The guard heater(s) around the hot plate and the sample set-up guarantee a linear, one-dimensional heat flow from the hot plate to the auxiliary heaters. The auxiliary heaters are in contact with a heat sink to ensure heat removal and improved control. By measuring the power input into the hot plate, the temperature gradient and the thickness of the two samples, the thermal conductivity can be determined according to the Fourier equation. The advantages of guarded hot plates compared to the heat flow meters are their broader temperature range (−180 to 650 C) and measuring range (up to 2 W/mK). Additionally, the guarded hot-plate technique is an absolute measurement technique because no calibration of the unit is required.

Transient measuring methods have become established in the last few decades for studying materials with high thermal conductivities and for taking measurements at high temperatures. Besides their high precision and broad measuring range, transient methods feature a comparably simple sample preparation and the ability to measure up to 2000 C. In the hot-wire method, a wire is embedded in a sample, generally a large brick. During the test run, a constant heating power is applied to this wire, causing the temperature of the wire to rise. The temperature increase is measured versus time at the heating wire itself or at a well-defined distance parallel to the wire. Because this measurement depends on the thermal conductivity of the tested materials, it provides an evaluation of this thermal conductivity.

Various methods can be used to measure the temperature rise of the wire. With the cross-wire method, the temperature increase is measured with a thermocouple that is directly welded onto the hot wire. With the parallel-wire method, the temperature increase is measured in a defined distance to the hot wire. In the temperature-resistance T(R)-method, the heating wire itself is used to measure the temperature increase. Here, the well known correlation between the electrical resistance of the hot wire (which is typically platinum) and the temperature is used.

The magnitude of the thermal conductivity to be measured is an important consideration in selecting the right method. The cross-wire method is suitable for measuring thermal conductivities below 2 W/mK, while the T(R) and parallel-wire methods are used for materials with higher thermal conductivities (15 and 20 W/mK, respectively).

Some instruments allow the use of all three methods. In one such instrument, tests can be carried out between room temperature and 1500 C. During the tests, the sample is brought to the required temperature. After the sample temperature has stabilized, the hot wire test can be run. This method provides the ability to measure large samples and characterize inhomogeneous ceramic materials and refractory products.

Another technique that can be used to investigate highly conductive materials and/or samples with small dimensions is the flash diffusivity method, also known as the laser-flash method. This method directly measures the thermal diffusivity of a material. If the specific heat and density of the sample are known, thermal conductivity can be determined. The specific heat can be directly measured with flash diffusivity using a comparative method; however, a differential scanning calorimeter is recommended to obtain the highest accuracies. Density and/or density alteration subject to temperature can be determined using dilatometry.

Using the flash diffusivity method, a plane-parallel sample is run in a furnace to the required test temperature. Afterwards, the front surface of the sample is heated with a short (<1 ms) light pulse produced by a laser or a flash lamp. The heat diffuses through the sample, leading to a temperature rise on the sample's rear surface. This temperature rise is measured versus time with an infrared detector. It is important to note that only the time-dependent behavior of the measuring signal is decisive, not its height.

This flash diffusivity instrument NETZSCH LFA 437 Microflash® manufactured by NETZSCH Instruments, Inc.37 North Ave., Burlington, Mass. 01803, can be used to analyze ceramic materials that are used as heat sinks or packaging in the electronics industry. The new LFA 447 NanoFlash™ light flash system manufactured by NETZSCH Instruments, Inc., makes thermal properties testing fast, easy and affordable. The Xenon flash lamp based NanoFlash™ uses optical coupling to heat and read the sample surfaces, eliminating potential interface thermal resistance, and making accurate measurement of thin samples, coatings on a substrate and materials in a thin film or sandwich possible. The NanoFlash™ can test samples both through and in the sample plane over a diffusivity range covering materials from neat and filled polymers to diamond. The NanoFlash™ is fully automated: powerful Windows based software controls the test temperature, flash lamp firing, and data analysis. The available automatic sample changer allows the instrument to measure multiple samples in one test.

Referring still to FIG. 2, in an additional embodiment of the present invention, the block 20 for detecting at least one threat signature by detecting an exchange of energy and/or matter of at least one threat with its surroundings comprises a mechanical stored energy detector 26 configured to detect an exchange of mechanical stored energy between at least one threat with its surroundings. In this embodiment, the mechanical stored energy detector is selected from the group consisting of: {a pressure stored energy detector; a stress stored energy detector; a tension tensile stored energy detector; and a tension compressive stored energy detector}.

Transducers convert one form of energy to another. Piezo motors (actuators) convert electrical energy to mechanical energy, and piezo generators (sensors) convert mechanical energy into electrical energy. In most cases, the same element can be used to perform either task. Piezo Systems, Inc., 186 Massachusetts Avenue, Cambridge, Mass. 02139, USA, manufactures both—piezo actuators and piezo sensors. Piezo sensors can be used for the purposes of the present invention as a pressure stored energy detector, as a stress stored energy detector, as a tension tensile stored energy detector, as and a tension compressive stored energy detector.

Indeed, single sheets can be energized to produce motion in the thickness, length, and width directions. They may be stretched or compressed to generate electrical output. Thin 2-layer elements are the most versatile configuration of all. They may be used like single sheets (made up of 2 layers), they can be used to bend, or they can be used to extend. "Benders" achieve large deflections relative to other piezo transducers. Multilayered piezo stacks can deliver and support high force loads with minimal compliance, but they deliver small motions.

Single Layer Generators comprise longitudinal and transverse generators. When a mechanical stress is applied to a single sheet of piezoceramic in the longitudinal direction (parallel to polarization), a voltage is generated which tries to return the piece to its original thickness. Similarly, when a stress is applied to a sheet in a transverse direction (perpendicular to polarization), a voltage is generated which tries to return the piece to its original length and width. A sheet bonded to a structural member which is stretched or flexed will induce electrical generation.

Applying a mechanical stress to a laminated two layer element results in electrical generation depending on the direction of the force, the direction of polarization, and the wiring of the individual layers. When a mechanical stress causes both layers of a suitably polarized 2-layer element to stretch (or compress), a voltage is generated which tries to return the piece to its original dimensions. Essentially, the element acts like a single sheet of piezo. The metal shim sandwiched between the two piezo layers provides mechanical strength and stiffness while shunting a small portion of the force.

When a mechanical force causes a suitable polarized 2-layer element to bend, one layer is compressed and the other is stretched. Charge develops across each layer in an effort to counteract the imposed strains. This charge may be collected as observed here. The stack of piezo layers, which comprises a large number of piezo layers, is a very stiff structure with a high capacitance. It is suitable for handling high force and collecting a large volume of charge.

Piezoelectric generators are usually specified in terms of their closed-circuit current (or charge) and open-circuit voltage. Closed-circuit current, $I_{CC}$, refers to the total current developed, at the maximum recommended strain level and operating frequency, when the charge is completely free to travel from one electrode to the other, and not asked to build up voltage. Open-circuit voltage, Voc, refers to the voltage developed at the maximum recommended strain level, when charge is prohibited from traveling from one electrode to the other. Current is at a maximum when the voltage is zero, and voltage is at a maximum when the charge transfer is zero. All other values of simultaneous current and voltage levels are determined by a line drawn between these points on a voltage versus current line.

Generally, a piezo generator should deliver a specified current and voltage, which determines its operating point on the voltage vs. current line. Maximum power extraction for a particular application occurs when the generator delivers the required voltage at one half its closed circuit current. All other generators satisfying the design criteria will be larger, heavier, and require more power input.

As a sensor or force gauge, piezo elements are excellent for handling dynamic and transient inputs, but poor at measuring static inputs. This is due to charge leakage between electrodes and monitoring circuits. Piezoceramic may be used as a strain gauge for easy and rapid determination of dynamic strains in structures. They exhibit extremely high signal/noise ratios, on the order of 50 times that of wire strain gauges, and are small enough that on most structures they will not materially affect the vibrational characteristics of the structure.

Series Operation refers to the case where supply voltage is applied across all piezo layers at once. The voltage on any individual layer is the supply voltage divided by the total number of layers. A 2-layer device wired for series operation uses only two wires, one attached to each outside electrode.

Parallel Operation refers to the case where the supply voltage is applied to each layer individually. This means accessing and attaching wires to each layer. A 2-layer bending element wired for parallel operation requires three wires; one attached to each outside electrode and one attached to the center shim. For the same motion, a 2-layer element poled for parallel operation needs only half the voltage required for series operation.

Referring still to FIG. 2, yet in one more embodiment of the present invention, the block 20 for detecting at least one threat signature by detecting an exchange of energy and/or matter of at least one threat with its surroundings comprises block 28 illustrating an infrared (IR) electromagnetic energy (EM) detector.

Sciencetech located at 96 Bradwick Drive, Concord, ON, L4K 1K8, Canada, offers integrated large area silicon and germanium detector systems. Their detector heads are specifically designed to measure the output of Sciencetech spectrophotometric systems ranging from ultraviolet to near-infrared wavelengths. The active area is large for easy alignment and light collection and is assembled on a detector head with electronics and preamplifiers. The head also includes an easy-release mount designed for Sciencetech monochromators. All detector systems include a plug-in power supply. For higher performance, Ge and Si—Ge heads are also available with thermoelectric cooling.

Silicon (Si) photodetector heads are offered with standard or UV enhanced Responsivity. Their active area is 5.5 mm in diameter and they include a built-in low noise amplifier and external power supply. The photo diode operates in photovoltaic mode (zero bias) to minimize noise and thermal drift.

For near IR, a Germanium (Ge)-based detector offers a large area at a reasonable price. Sciencetech offers room temperature and Peltier cooled systems. The room temperature Germanium (Ge) photodetector system has an active area of 5 mm diameter and a built-in low noise amplifier which is chopper stabilized. This photodiode also operates in photovoltaic mode. The thermoelectrically cooled system, also with a 5 mm diameter Ge photodetector, features a built-in low noise amplifier and a 2 stage Peltier cooler. The power supply for the preamplifier and cooler is included.

The Silicon-Germanium Detectors include both silicon and germanium detectors used for the spectral range of 200 nm to 1.9 μm at room temperature. Preamplifiers and electronics for both Si and Ge detectors are included in the detector head. A thermoelectric cooled model is also available.

Referring still to FIG. 2, yet in one additional embodiment of the present invention, the block 20 for detecting at least one threat signature by detecting an exchange of energy and/or matter of at least one threat with its surroundings comprises block 30 illustrating a visible spectrum (VS) electromagnetic energy (EM) detector.

More specifically, embodiment of the present invention, the block 20 for detecting at least one threat signature by detecting an exchange of energy and/or matter of at least one threat with its surroundings comprises block 30 illustrating a color sensor detector (not shown) that is configured to detect not only the presence of the VS energy, but also the particular color of the source of visible spectrum (VS) power. For the purposes of the present invention, it can be an intruder using a flashlight inside the container, or using an open door as a source of sunlight, or moon light as a source of light to enable the intruder to see inside the container at night.

Color sensors register items by contrast, true color, or translucent index. True color sensors are based on one of the color models, most commonly the RGB model (red, green, blue). A large percentage of the visible spectrum can be created using these three primary colors. Many color sensors are able to detect more than one color for multiple color sorting applications. Depending on the sophistication of the sensor, it can be programmed to recognize only one color, or multiple color types or shades for sorting operations. Some types of color sensors do not recognize colors per se, instead focusing on light wavelengths. These devices can be configured to locate wavelengths from near infrared (colors in the 750 nm to 2500 nm wavelength range), far infrared (colors in the 6.00 to 15.00 micron wavelength range), and UV (colors in the 50 to 350 and 400 nm wavelength range), in addition to the visible range. Sensors that read the visible range are the most common type of color sensors. They measure color based on an RGB color model (red, green, blue). A large percentage of the visible spectrum (380 nm to 750 nm wavelength) can be created using these three colors.

Color sensors are generally used for two specific applications, true color recognition and color mark detection. Sensors used for true color recognition are required to "see" different colors or to distinguish between shades of a specific color. They can be used in either a sorting or matching mode. In a sorting mode, output is activated when the object to be identified is close to the set color. In matching mode, output is activated when the object to be detected is identical (within tolerance) to the color stored in memory. Color mark detection sensors do not detect the color of the mark, rather they "see" differences or changes in the mark in contrast with other marks or backgrounds. They are sometimes referred to as contrast sensors.

Color sensors shine light onto the object to be monitored and measure either the direct reflection or the output into color components. Many color sensors have integral light sources to achieve the desired effect. These integral light sources include LEDs, lasers, fiber optic, and halogen lamps.

MAZeT GmbH, located at Göschwitzer Straβe 32, 07745 JENA, GERMANY, offers custom built developments of opto-electronical ICs with/without signal electronic on chip. These sensor systems are optimally adaptable to respective applications, due to variable technologies (e.g. HML and CDPA), optional carrying out forms as well as bandpass filter (e.g. Infrared, RGB, V-Lambda) and optics on chip. The sensor ICs are suitable for most different areas of application, for example light sensors and for the availability test by means of light barrier and photo sensor, triangulation, geometry recording of light beams, measurement of the light emphasis and of light intensity, edge or position recognition, spectral measurements and color recording. Both the geometry and the numbers of the photodiodes can almost be chosen as desired. For signal processing of the optosensors MAZeT offers the multi-channel transimpedance amplifiers MTI with a maximum of 32 channels. The input current can be varied in three stages at these amplifiers and is in this way adapted to the photo current to be measured, even during any online measurement process.

Referring still to FIG. 2, yet in another more embodiment of the present invention, the block 20 for detecting at least one threat signature by detecting an exchange of energy and/or matter of at least one threat with its surroundings comprises block 32 illustrating an ultraviolet (UV) electromagnetic energy (EM) detector.

Sensor Physics located at 8425 S Timberline Road, Fort Collins, Colo. 80525, offers two types of materials for ultraviolet beam measurement: UVSC-200 SensorFilm are 8×10 inch sheets of polyester coated with a thin layer of polymer. This polymer turns blue on exposure to UV beams from 220–320 nm. The color change is instant and irreversible. No development is required. Long term (several days) exposure to fluorescent light and outdoor UV exposure will also cause the polymer to change color. The effective grain size is about 1 um.

The FilmScan software allows each gray scale value of the image to be assigned a false color. This makes it easy to see qualitative differences in exposure uniformity. A red color represents a greater exposure. Quantitative analysis includes beam diameters, uniformity, 3D display, X and Y profiles, and average profile plots of intensity of UV exposure versus position on the beam. Images are saved in TIFF and BMP formats and data are exported via the Windows clipboard and as ASCII data files. Windows (3.11, 95, 98, NT, 2000 based) software is provided. A lookup table is provided to allow the Optical Density (OD) of the film to be converted to mJ/cm2. This converts the XY plots to mJ/cm2. To obtain qualitative and quantitative data from the Sensor Cards, a digitizing system (FilmReader) based on an illuminating light box, CCD camera and lens can be used. The precise configuration of the hardware depends on the image size and required spatial resolution. To process the information the FilmScan software and frame grabber board can be utilized. This is available for both desktop (FS-2000) and notebook (FS-2000U) computers operating under the Windows 95, 98, 2000 and NT operating systems. A variety of light box and microscope systems are offered for Sensor Card reading.

SD-Series SmartDetectors™ manufactured by Small Planet Photonics, located at 4790 Irvine Blvd. Suite#104, Irvine, Calif. 92620, eliminate the hassle of having to (1)

estimate the amlitude of the light signal, (2) to choose the right gain detector before starting the measurement, and (3) finally, trying to find the right ND-filter.

A SmartDetector™ is like having several detectors in one because the detector's autoranging switches the gain as one aligns the setup. There are germanium, silicon and UV-enhanced silicon versions of the SmartDetector™. After aligning has been done, one has two choices: (1) to use SmartDetector™ as an ordinary amplified photodiode by switching the autoranging off and leaving the detector on your chosen gain setting, or (2) to consider the benefit of the increased dynamic range if the autoranging is left on while a SmartDetector™ is in use. Even though the 16-bit DAQ produces an integer as large as 65,000, one can take into account a factor of two to avoid clipping and factor of 1,000 for 0.1% accuracy, an there is still a factor of 30 in the dynamic range.

Referring still to FIG. 2, yet in another embodiment of the present invention, the block 20 for detecting at least one threat signature by detecting an exchange of energy and/or matter of at least one threat with its surroundings comprises block 34 illustrating an RF electromagnetic energy (EM) detector.

For the purposes of the present invention, the usage in side a cargo container any device that transmits the RF energy can be detected by using an RF detection device.

Family Defense Products, located at 3351 S. W. 56 Avenue, Ocala, Fla. 34474, sells the JM-20 Pro RF detector is the latest technology in hand-held radio frequency detection. It incorporates sophisticated circuitry, which makes sweeping for RF transmitters effective and efficient, with full spectrum coverage. JM-20 Pro RF detector includes at least five LED bar graph that pinpoints the location of RF transmitters. JM-20 Pro RF detector detects the RF transmission by using the following three methods: audio, vibration, and visual (LED bar graph). The frequency range is: 1 MHz to 3 GHz.

Referring still to FIG. 2, in still another embodiment of the present invention, the block 20 for detecting at least one threat signature by detecting an exchange of energy and/or matter of at least one threat with its surroundings comprises block 36 illustrating an X-ray electromagnetic energy (EM) detector.

For the purposes of the present invention, the usage inside a cargo container any device that transmits the X-ray energy, or presence in the container of any radioactive material can be detected by using an X-ray detection device.

Electron Tubes Ltd, located at Bury Street, Ruislip, HA4 7TA, Middlesex, UK, specializes in designing X-ray detection systems to meet customer requirements. These make use of scintillation and light detection techniques, both areas in which ETL has a very long experience. In addition ETL has the capability to design complete detector sub-systems including read-out electronics, data communications and signal processing.

The sensor element consists of a linear array of silicon photodiodes with a scintillation material mounted on the photodiodes. The X-rays are stopped by the scintillation, causing light to be emitted. The light produces charge in the photodiode which is processed by the electronic read-out system, generating an output which is proportional to the intensity of the incident radiation.

The choice of scintillation type and thickness depends on the X-ray energies and the speed of response of the system. The main options are cadmium tungstate and caesium iodide, used as single crystals, or gadox in the form of a phosphor deposited on a screen. The detection elements may be cooled by Peltier devices to achieve low noise and stabilize light output from the scintillation. The overall length and resolution of the detector can be chosen to meet customer requirements. Detectors are built up in the form of modules, normally with either 32 or 128 elements, depending on the pitch required. Modules can be butted end-to-end to provide a longer array, with a constant pitch being maintained along the whole length. The electronics is highly integrated and makes use of one of a range of multi-channel, monolithic charge integrating amplifiers developed specifically for X-ray detector read-out by the Rutherford Appleton Laboratory in the UK. These are very low noise devices with fast read-out, in serial form using an on-chip shift register. Sensitivity can be varied by means of integration time control. In most applications signal-to-noise is limited by X-ray quantization noise, which is the theoretical ideal. ETL designs customized systems, which may also include other features such as on-board generation of clock and control signals, analogue to digital conversion, and a communications interface to transmit the data to a remote central processor. Particular attention is paid to protection of the electronics from radiation damage and lead screening is used to protect the most radiation sensitive elements.

Referring still to FIG. 2, in still another embodiment of the present invention, the block 20 for detecting at least one threat signature by detecting an exchange of energy and/or matter of at least one threat with its surroundings comprises block 38 illustrating an γ-ray electromagnetic energy (EM) detector.

For the purposes of the present invention, the usage inside a cargo container any device that transmits γ-ray energy, or presence in the container of any radioactive nuclear material can be detected by using an γ-ray detection device.

Gamma-Scout® is the latest development in handheld general purpose Geiger counters. Designed around an accurate and reliable Geiger-Müller detector, the Gamma-Scout® Geiger counter is light, compact, with a unique ergonomic design that fits comfortably in hand or pocket. The data from Geiger counter can be transferred to PC or Notebook for evaluation.

Gamma-Scout® was developed by Eurami Group based in Baltimore, Md.

The Savannah River Technology Center developed a Real Time Sodium Iodide Gamma Detector (RADMAPS) that can be used for detecting, locating and characterizing nuclear material. The portable field unit records gamma or neutron radiation spectra and its location, along with the date and time, using an imbedded Global Positioning System. RADMAPS is an advancement in data fusion, integrating several off-the-shelf technologies with new computer software in a product that is simple to use and requires very little training. The existing technologies employed in this system include: Global Positioning System satellite data, radiation detection (scintillation detector), pulse height analysis, Flash Memory Cards, Geographic Information System software and laptop or personal computers with CD-ROM supporting digital base maps. The software developed at the Savannah River Technology Center eliminates costly, error prone, manual data entry. An initial screening survey is performed to establish the level of naturally occurring (background) radiation. This screening survey becomes the point of reference as the detailed survey continues, looking for radiation 'spectra' (fingerprints). All pertinent data, including the time each spectrum is accumulated, is stored.

Figure 3:
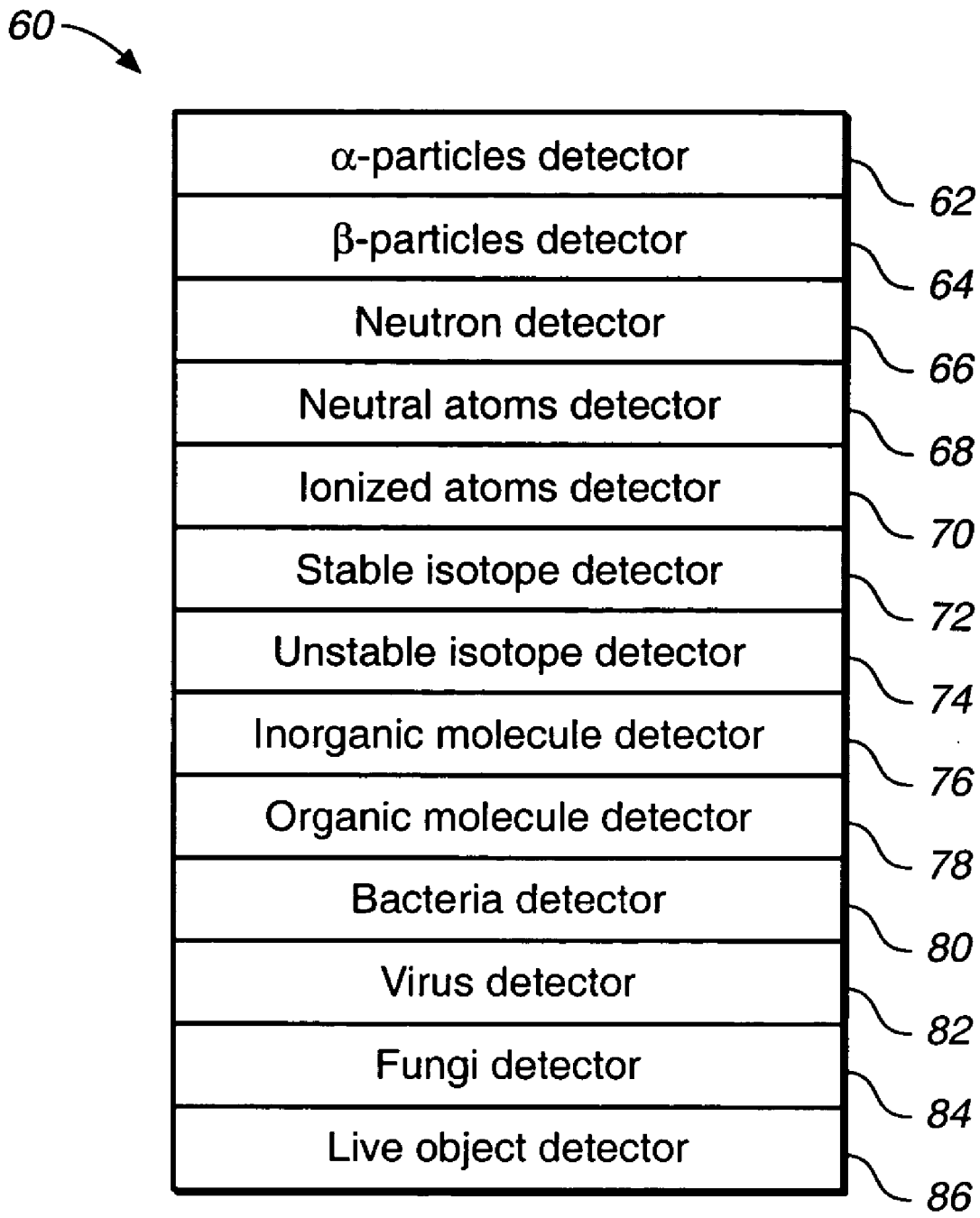
FIG. 3 illustrates the block for detecting an exchange of matter of the threat with its surroundings by detecting particles selected from the group consisting of: {subatomic particles; elements; molecules; and life forms} and comprises: an alpha particles detector, a beta particles detector, neutrons detector, a neutral atoms detector, an ionized atoms detector, a stable isotopes detector, an unstable isotopes detector, an inorganic molecules detector, an organic molecules detector, a bacteria detector, a viruses detector, a fungi detector, and a life object detector.

In one embodiment of the present invention, as shown in FIG. 3, the block 60 for detecting an exchange of matter of the threat with its surroundings by detecting particles selected from the group consisting of: {subatomic particles; elements; molecules; and life forms}.

More specifically, in one embodiment of the present invention, the block 60 for detecting at least one threat signature by detecting an exchange of matter of at least one threat with its surroundings further comprises an alpha particle detector 62. It is well known, that heavy radioactive elements emit alpha particles at discrete energy values.

For the purposes of the present invention, the usage of an alpha particle detector 62 allows one to detect inside a cargo container any device that transmits alpha particles, or presence in the container of any radioactive nuclear material can be detected by using the alpha particle detector 62.

The alpha particle detector is essentially a silicon diode with a large area face. Because alpha particles, which are high-speed helium nuclei, are electrically charged, they interact strongly with matter and lose their energy quickly upon entering a solid. When an alpha particle decelerates within the depletion region of the diode, it creates electron-hole pairs. The carriers are collected by the diode's electrodes and create a measurable current pulse.

Canberra Industries, located at 800 Research Parkway, Meriden, Conn. 06450, manufactures a modern version of the charged particle detector called PIPS, an acronym for Passivated Implanted Planar Silicon. The PIPS detector employs implanted rather than surface barrier contacts and is therefore more rugged and reliable than the Silicon Surface Barrier (SSB) detector it replaces.

At the junction there is a repulsion of majority carriers (electrons in the n-type and holes in p-type) so that a depleted region exists. An applied reverse bias widens this depleted region which is the sensitive detector volume, and can be extended to the limit of breakdown voltage. PIPS detectors are generally available with depletion depths of 100 to 700 μm. Detectors are specified in terms of surface area and alpha or beta particle resolution as well as depletion depth. The resolution depends largely upon detector size, being best for small area detectors. Alpha resolution of 12 to 35 keV and beta resolutions of 6 to 30 keV are typical. Areas of 25 to 5000 $\mu m^2$ are available as standard, with larger detectors available in various geometries for custom applications.

The A series of PIPS detectors manufactured by Canberra Industries are optimized for high resolution, high sensitivity, and low background alpha spectroscopy. The thin window of the PIPS detector provides enhanced resolution with the close detector-source spacing needed for high efficiency. The low leakage current helps minimize peak shift with temperature variation. Detectors in the A-PIPS series are fabricated with specially designed and selected packaging materials which reduce alpha background and are processed and tested in low background conditions to avoid contamination from alpha-emitting radio nuclides. Because of these measures, the background count rate for A-series PIPS detectors is typically less than 0.05 counts/hr/$cm^2$ in the energy range of 3 to 8 MeV. Alpha PIPS detectors have a minimum active thickness of greater than 140 μm which is sufficient for full absorption of alpha particles of up to 15 MeV.

Referring still to FIG. 3, in another embodiment of the present invention, the block 60 for detecting at least one threat signature by detecting an exchange of matter of at least one threat with its surroundings further comprises a beta particle detector 64.

Beta particles are subatomic particles ejected from the nucleus of some radioactive atoms. They are equivalent to electrons. The difference is that beta particles originate in the nucleus and electrons originate outside the nucleus. While beta particles are emitted by atoms that are radioactive, beta particles themselves are not radioactive. It is their energy, in the form of speed, that causes harm to living cells. When transferred, this energy can break chemical bonds and form ions.

For the purposes of the present invention, the usage of the beta particle detector 64 allows one to detect inside a cargo container any device that transmits beta particles, or presence in the container of any radioactive nuclear material can be detected by using the beta particle detector 64.

Canberra Industries manufactures the B series of PIPS detectors optimized for beta counting and electron spectroscopy. The naturally-thin entrance window of the PIPS detector provides little attenuation for even weak betas but the B-PIPS is especially good in this application because of the extra thickness and low noise of this series. The minimum thickness of B-PIPS detectors is 475 μm. The B-series PIPS detectors are selected for low noise in order to: maximize the realizable efficiency for low energy betas, and to provide good resolution for conversion electrons. Since the minimum discriminator level (below which noise counts are excessive) is about 2.5–3 times the noise measured in (keV) FWHM, the low noise of the B-PIPS is extremely important in helping resolve true beta counts from system noise counts.

Referring still to FIG. 3, in one more embodiment of the present invention, the block 60 for detecting at least one threat signature by detecting an exchange of matter of at least one threat with its surroundings further comprises a neutron detector 66.

Neutron is an electrically neutral elementary particle that is part of the nucleus of the atom. Elementary particles are the smallest parts of matter that scientists can isolate. The neutron is slightly heavier than a proton and 1,838 times as heavy as the electron. It is affected by all the four fundamental forces of nature. Because it has mass, it is affected by gravitation, the force of attraction between all objects in the universe. Although the neutron has no electrical charge, it is slightly magnetic, so it is affected by the electromagnetic force, the force of attraction or repulsion between electrically charged or magnetic objects. The neutron is affected by the strong nuclear force, an attraction that binds the neutron to protons and other neutrons in the nucleus. The neutron is also affected by the weak nuclear force, an interaction among the building blocks of the neutron that causes the neutron to decay, or break apart. Isolated from nuclear matter, a free neutron decays into a positively charged proton and a negatively charged electron, releasing energy in the process. The average lifetime of a free neutron is just under 15 minutes.

For the purposes of the present invention, the usage of the neutron detector 66 allows one to detect inside a cargo container any device that transmits neutrons, or presence in the container of any radioactive nuclear material can be detected by using the neutron detector 66. The most plausible candidate to be detected by using a neutron detector is the smuggled uranium for further usage as a dirty radioactive bomb.

The most commonly deployed neutron detector is a proportional counter. It costs at least $30,000 for a model with a detection area of 1 square meter. Indeed, a proportional counter with a detection area of 1 square meter requires about twenty 1-meter-long gas-filled tubes, each costing about $1,200. Because a proportional counter uses gas multiplication, its detection signal is highly sensitive to gas impurities. Thus, the gas in a proportional-counter tube should be at least 99.999 percent pure. In fact, about half the cost of a helium-3 proportional-counter tube is in its high-purity gas.

Los Alamos Lab scientists have developed a rugged, inexpensive neutron detector—made largely of plastic—that could be mass-produced. Los Alamos scientist Kiril Ianakiev has developed an attractive alternative: a new breed of neutron detector. The detector's major parts include spark plugs, welding gas, and a briefcase-sized block of plastic that forms its body. The detector is rugged and inexpensive enough to be widely deployed. Ianakiev's detector which does not use gas multiplication works even with inexpensive welding-grade argon, which has a purity of 99.5 percent. Furthermore, the small amounts of oxygen, water vapor, and carbon dioxide slowly emitted from the detector's interior surfaces will be absorbed by the lithium coating, so that outgassing will not affect detector performance for twenty years or more.

Ianakiev's detector is also a good neutron detector: it detects 10 percent of the neutrons emitted by plutonium-240 that strike it. Weapons-grade plutonium typically contains about 5 percent plutonium-240. By comparison, a proportional counter detects 15 percent of the neutrons. But a proportional counter is also nearly ten times more expensive. One of Ianakiev's detectors with a 1-square-meter detection area will cost about $4,000. To further reduce the cost of deployment of Ianakiev's detectors, the mass-production techniques and inexpensive materials are being considered.

Referring still to FIG. 3, in one more embodiment of the present invention, the block 60 for detecting at least one threat signature by detecting an exchange of matter of at least one threat with its surroundings further comprises a neutral atom detector 68.

Max Planck Institute for Solar System Research, located at Max-Planck-Str. 237191, Katlenburg-Lindau, Germany, produced a very simple neutral particle detector (NPD) sensor consisting of two identical detectors, each of which is a pinhole camera. In each detector the charged particles with energies up to 70 keV, electrons and ions, are removed by the deflection system which consists of two 90° sectors separated by a 4.5 mm gap. Apart from being ON or OFF the deflection system can be operated in the alternative mode. The energetic neutral atoms (ENA) beam emerging from the 4.5×4.5-mm pin-hole hits the START surface under the grazing angle 20° and causes the secondary electron emission. By a system of collecting grids, the secondary electrons (SE) are transported to one of two MCP assemblies giving the START signal for the time-of-flight (TOF) electronics. Depending on the azimuth angle the collection efficiency varies from 80% to 95%. The incident ENAs are reflected from the START surface near-specularly. Since the charge state equilibrium is established during the interaction with the surface, the emerging beam contains both the neutral and ionized (positive and negative) components. To increase the total efficiency, no further separation by the charge is made. As proven by the ion tracing, there is very little disturbance to the reflected atomic ions leaving the START surface with an energy above 80 eV, introduced by the START electron optics. Therefore particles of all charge states—negative, neutral, and positive—will impact the second surface, the STOP surface, and again produce secondary electrons which are detected by one of the three microchannel plates (MCP) assemblies giving the STOP signal. The time of flight over the fixed distance of 8 cm defines the particle velocity. The STOP MCPs also give the azimuthal direction. Since the secondary electrons (SE) yield depends on mass for the same velocity, the pulse height distribution analysis of the START signals and independent analysis of the STOP signals provide the estimation of ENA mass. Each event is stored in the array START MCP charge×STOP MCP charge×time-of-flight x direction.

The UV suppression in Neutral Particle Detector (NPD) is based on the coincidence of START/STOP signals. To increase the particle reflectivity, it is considered to use very smooth (roughness is of the order of 5–10 Å) metal surfaces. On the other hand the STOP surface is proposed to be made of graphite (roughness around 100 nm) covered by MgO. This combination has a very high secondary electron yield, low photoelectron yield and high UV absorption. Both proposed surfaces are stable and do not require special maintaining.

Referring still to FIG. 3, in one more embodiment of the present invention, the block 60 for detecting at least one threat signature by detecting an exchange of matter of at least one threat with its surroundings further comprises an ionized atoms detector 70.

A semiconductor particle detector is a device that uses a semiconductor (usually silicon) to detect the passage of charged particles. In the field of particle physics, these detectors are usually known as silicon detectors. Most silicon detectors work, in principle, by doping, to make them into diodes. As charged particles pass through these strips, they cause small leakage currents which can be detected and measured. Arranging thousands of these detectors around a collision point in a particle accelerator can give an accurate picture of what paths particles take. Silicon detectors have a much higher resolution in tracking charged particles than older technologies such as cloud chambers or wire chambers. The drawback is that silicon detectors are much more expensive than these older technologies and require sophisticated cooling for their electronics as well as suffer degradation over time from radiation.

Silicon counters are sometimes called 'solid state wire chambers' because here in principle the same is happening like in a wire chamber. Silicon atoms are ionized along the track of a charged particle, and the freed electrons drift to the readout electrode. The ionized atoms don't drift, instead they receive an electron from their neighboring atom, which again receives an electron from it's neighbor, and so on, so that a positive 'hole' drifts to the other electrode. The electrodes are on the surfaces of the silicon chip, so the field lines are orientated perpendicular to the chip.

In the COSY-11 experiment designed for the measurement of meson production reactions by Institute of Nuclear Physics (IKP), Research Center Jülich (FZJ), Germany, and Central Electronics Laboratory (ZEL), Research Center Julich (FZJ), Germany, the silicon counters are called silicon pad detectors, because the electrodes on the readout side of the chips comprise four rectangular areas ('pads'). To form a large detectors these chips are staggered in three rows which overlap in order to get a complete geometrical coverage: The pads are connected to AMPLEX-16 chips which contain 16 readout channels each consisting of a charge amplifier, a filter amplifier, and a sample-and-hold stage. These are followed by a multiplexer which switches the stored voltages sequentially to a single analog wire that is connected to an external ADC. There are two detectors made of these silicon pads in the COSY-11 experiment: the small monitor detector (36 chips=128 pads) for the measurement of elastically scattered protons and the longer (180 chips=720 pads) one inside the dipole gap to detect reaction products with negative charge.

Thus, for the purposes of the present invention, silicon detectors can be used to detect different ionized atoms that can reveal the presence inside a container hazardous materials which would be considered as a potential threat to the homeland security.

Referring still to FIG. 3, in an additional embodiment of the present invention, the block 60 for detecting at least one threat signature by detecting an exchange of matter of at least one threat with its surroundings further comprises a stable isotopes detector 72.

The Thermo Electron Corporation, sales location in the USA at: 355 River Oaks Parkway, San Jose, Calif. 95134–1991, sells the Finnigan NEPTUNE—a high performance Multicollector-ICPMS with high mass resolution capabilities for high precision isotope ratio measurements. It combines highest sensitivity and highest stability for all elements with the latest multicollector technique. High mass resolution on all detectors is the key to discriminate against molecular interferences. The design of the Finnigan NEPTUNE multicollector ICP-MS is based on the sum of company experience in multicollector technology and ICP-MS. The system incorporates the unique features of the TRITON analyzer and the ELEMENT2 plasma interface, which provide the basis for a uniquely powerful MC-ICS-MS.

The Finnigan TRITON gives the ultimate precision for isotope ratio measurements on solid samples. It uses a proven thermal ionization source and has a unique variable multicollector platform which can be configured with Faraday detectors and/or miniaturized ion counting detectors for smallest sample sizes. Typical applications are dating of geological samples as well as control of isotopic compositions of nuclear materials.

The Finnigan TRITON is a completely new thermal ionization mass spectrometer (TIMS) delivering the most precise and accurate isotope ratios ever achieved with TIMS for positive and negative ions. Through its innovative technology, including Virtual Amplifiers™, Dynamic Zoom™ and all-carbon plug-in Faraday cups, the TRITON sets a new standard for TIMS. Major applications are in isotope geology, geochemistry and planetary research. The TRITON is the first system built on Thermo Electron's new multicollector platform. The TRITON has the following features: thermal ionization isotope ratio MS (TIMS) with multicollector, the most precise and accurate TIMS ever, novel patented technology to overcome traditional shortcomings of multicollector MS, guaranteed 5 ppm external precision on Sr and Nd, and high abundance filter (RPQ) and multi-ion-counting options.

Just as TRITON and ELEMENT2 redefined the TIMS and high resolution ICP-MS respectively, the Finnigan NEPTUNE is expected to redefine the practice of multicollector ICP-MS. The Finnigan NEPTUNE offers a high resolution multicollector inductively coupled plasma mass spectrometer (MC-ICP-MS), and precise and accurate isotope ratios of most of the periodic table. It includes the novel ion optical and detector technologies from TRITON including a multicollection with high mass resolution, a high abundance filter (RPQ), and multi-ion-counting options.

Thus, for the purposes of the present invention, the Finnigan TRITON and the Finnigan NEPTUNE detectors can be used to detect different stable isotopes that can reveal the presence inside a container hazardous materials which would be considered as a potential threat to the homeland security.

Referring still to FIG. 3, in an additional embodiment of the present invention, the block 60 for detecting at least one threat signature by detecting an exchange of matter of at least one threat with its surroundings further comprises an unstable isotopes detector 74.

Radioactivity is a property of unstable isotopes which undergo spontaneous atomic readjustment with the liberation of particles and/or energy (e.g., alpha or beta particles, neutrons, and gamma rays). Alpha and beta emission change the chemical nature of the element involved. The loss of energy will result in the decay or transformation of the unstable isotope into a stable isotope; or transmutation into an isotope of another element, sometimes giving rise to emission of neutrons.

Most unstable isotopes decay by releasing energy in the form of alpha or beta particles or gamma rays. However, there is a rare form of radioactive decay called proton radioactivity, produced when an unstable isotope releases a proton.

The process of radioactive decay is one of conversion of mass to energy in accordance with Einstein's relationship, $E=mc^2$. Nearly all of the energy of emitted particles and photons is converted to heat in the near vicinity of the radioactive parent. This is one means by which the temperature of the earth is maintained.

Nuclear Radiation Detector RS-500 detects: Alpha, Beta and Gamma particles and X-Rays. It has an operational range: 0–999 mR/hr and can detect the radioactive decay energy in the range: 40 KeV to 1.2 MeV or better. The six digit LCD screen displays either the instant radioactivity or the cumulative radiation exposure. The sensitivity is 3 to 5% of all gamma entering the tube. The RS-500 detector is widely available through the on-line shopping.

Thus, for the purposes of the present invention, the RS-500 detector can be used to detect the presence of nuclear material inside the container which would constitute a clear and present danger to the national security.

Referring still to FIG. 3, in one additional embodiment of the present invention, the block 60 for detecting at least one threat signature by detecting an exchange of matter of at least one threat with its surroundings further comprises an inorganic molecular detector 76. In one more embodiment of the present invention, the block 60 for detecting at least one threat signature by detecting an exchange of matter of at least one threat with its surroundings further comprises an organic molecular detector 78.

Both inorganic molecular detector 76 and organic molecular detector 78 can be implemented by using two novel techniques: (1) surface-enhanced Raman scattering (SERS) on colloidal metal nanoparticles and (2) luminescent semiconductor nanocrystals (i.e., quantum dots).

In the past decade, numerous techniques, such as laser-induced fluorescence (LIF), have demonstrated the capability of detecting single molecules. However, these techniques do not often provide sufficiently detailed structural information necessary for chemical identification. For example, LIF measurements yield little structural information while also requiring a fluorescent label that suffers from rapid photobleaching. Recent research has developed two new methods of detection that can overcome some of these drawbacks: (1) surface-enhanced Raman scattering (SERS) on colloidal metal nanoparticles and (2) luminescent semiconductor nanocrystals (i.e., quantum dots).

Raman spectroscopy is capable of providing highly resolved vibrational information at room temperature and does not suffer from rapid photobleaching. However, Raman scattering is an extremely inefficient process with scattering cross sections ($\sim 10^{-30}$ $cm^2$ per molecule) approximately 14 orders of magnitude smaller than the absorption cross sections (~$10^{-16}$ $cm^2$ per molecule) of fluorescent dye molecules. To achieve single-molecule sensitivity, the normal Raman scattering efficiency should be enhanced $10^{14}$ fold or more. Such enormous degrees of enhancement have been achieved using silver and gold nanoparticles. These particles are relatively large (>50 nm in diameter), faceted nanocrystals that are able to enhance the Raman scattering cross sections of adsorbed analyte molecules by as much as $10^{15}$ fold. This large enhancement allows both the detection and identification of single, nonfluorescent molecules. Both electromagnetic-field and chemical enhancement models are used to explain the SERS phenomenon. Currently, the overall molecular detection efficiency of these studies has been relatively low (<10% analyte molecules detected/analyte molecules in sample) because not all molecules are adsorbed, not all adsorbed molecules are surface-enhanced, and not all nanoparticles are SERS-active. Great strides towards producing efficient and reliable SERS-substrates can thus be made by improving nanoparticle synthesis, separation, and assembly methods. The focus is on developing novel synthesis and assembly strategies to create highly SERS-active nanostructures to make ultrasensitive analytical measurements.

The new class of quantum dot (QD) based fluorescence correlation spectroscopy can be also used for the purposes of detection of organic as well as inorganic molecules.

Referring still to FIG. 3, in one additional embodiment of the present invention, the block 60 for detecting at least one threat signature by detecting an exchange of matter of at least one threat with its surroundings further comprises a bacteria detector 80.

There are air detectors configured to detect the bacteria via air. For example, the city and county health officials of the City of Houston's Health and Human Services are following up on the detection by air sensors of low levels of parts of the bacterium that causes tularemia, a treatable illness occasionally found in humans but more common in rabbits and rodents.

Researchers at the CNRS, the Université Pierre et Marie Curie, INSERM and the Research and Development Division of Electricité de France (EDF) have developed a new method for detecting *legionella* bacteria in less than four hours that does not require standard bacteria culture. The *Legionella pneumophila* bacteria, identified by a fluorescent marker specific to the strain in question, is detected and enumerated using an original cytometry technique. This study appears in the March issue of the American journal Applied Environmental Microbiology.

The BDS (Pall Corporation) detects bacterial growth by their use of oxygen. The effect of platelets is neutralized by sampling through a platelet retaining filter. Detection sensitivity is 100–500 CFU/mL. This study evaluates a new BDS (eBDS) enhanced by 1) removing the filter for optimal bacteria transfer; 2) modification of the culture tablet to enhance bacterial growth and reduce the respiration of platelets; and 3) agitated incubation of the sample pouch.

The New Horizons Diagnostics Corporation located at 9110 Red Branch Road, Columbia, Md. 21045, USA, has developed a number of tests to detect a number of bacteria.

PROFILE® 1 is a test that allows one to perform a rapid bacteria detection in under 5 minutes. The PROFILE® 1 Bioluminometer is a hand-held instrument capable of determining the presence of low levels of bacteria. PROFILE® 1 is able to differentiate microbial from somatic cells, yeast from bacteria, and can eliminate interfering (quenching) substances from the sample. To maximize specificity, a series of simple, patented, sample preparation steps are used to remove ATP arising from human cells and other interfering compounds. PROFILE® 1 will detect only viable organisms. Studies performed by the USDA, Agriculture Canada, DOD, University of Michigan, and others have shown an excellent correlation to standard culture methods. Results are read on the LCD display.

Cholera and Bengal SMART™ are calorimetric tests specific for *Vibrio cholerae*-O1 and *Vibrio cholerae*-O139 which allows for results in 5–10 minutes if there is a contact with the source of Cholera and Bengal bacteria.

GonoGen™ is a monoclonal antibody based coagglutination test intended for the confirmatory identification of *Neisseria gonorrhoeae*. The test does not require isolated, viable or fresh cultures. After heating the specimen and two minute rotation, a positive reaction will be indicated be clumping with the detection reagent.

SMART™ Group A Strep is a colorimetric test specific for Group A streptococcal polysaccharide which can detect as few as 104 organisms quickly if there is a contact with the source of bacteria. Results are available in 10 minutes.

TRUST is CDC approved as a STANDARD STATUS TEST for the Quantitative and Qualitative serologic detection of Syphilis if there is a contact with the source of bacteria. Smooth negatives are attained by the use of a dye (toluidine red unheated serum) versus the inconsistencies of burned charcoal. Room temperature storage, no glass ampules, and cost effective pricing make TRUST a sensitive and specific alternative for RPR and other more expensive nontreponemal tests for Syphilis.

SMART™-II Anthrax (Spore) is designed to detect *Bacillus anthracis* spore from environmental samples. It is not intended to be used in the diagnosis of anthrax or any other disease.

SMARTS™ Cholera O1 test features: less than 20 seconds technician time, room temperature storage, distinct color reaction on capture membrane.

The SMART™ II Ricin test features: less than 20 seconds technician time; room temperature storage; distinct color reaction on capture membrane.

The SMART™ II Yersina Pestis (F1) (Plague) test features: less than 20 seconds technician time, room temperature storage, distinct color reaction on capture membrane. This test is designed to detect Yersina Pestis from environmental samples. It is not intended to be used in the diagnosis of Yersina Pestis or any other disease.

The SMART™-II Botulism Toxin test features: less than 20 seconds technician time, room temperature storage, distinct color reaction on capture membrane. This is a proven technology—it was "Desert Storm Tested". This test is designed to detect Botulism toxin from environmental samples. It is not intended to be used in the diagnosis of botulism or any other disease.

For the purposes of the present invention, a combination of molecular detectors disclosed above can be used to detect the bacterial threat to the homeland security hidden inside one of the cargo containers.

Referring still to FIG. 3, in one additional embodiment of the present invention, the block 60 for detecting at least one threat signature by detecting an exchange of matter of at least one threat with its surroundings further comprises a virus detector 82.

Israeli technology is leading the way in the race to develop a method of quickly detecting the presence of viruses that cause illnesses. Such rapid and early detection will go a long way towards helping to slow their spread in the future.

Integrated Nano-Technologies, a leading U.S. company, is now using Israeli technology developed at the Haifa Technion as the backbone of a new DNA-based testing system called BioDetect that will rapidly and accurately test for the presence of biological pathogens, such as the virus that causes SARS as well as anthrax and smallpox. According to a World Health Organization (WHO) report, a total of 3,169 cases of SARS, with 144 deaths, have been reported to WHO from 21 countries. The Rochester, N.Y.-based Integrated Nano-Technologies has acquired from the Technion Research and Development Foundation in Haifa the right to use three patents developed by its researchers which cover the metallization of DNA, and form the basis for the BioDetect system. Technion's ground breaking work in this field has been recognized through publications in the journals Science and Nature.

According to the company, the Israeli technologies, when combined with INT's expertise in chip fabrication and molecular biology, will produce an entirely new and more effective sensor for virus detection.

The BioDetect system will fill a substantial void in current methods of detection, which are slow, lab-based and expensive. The system will return results in less than 30 minutes, and is small enough to be carried for use outdoors or installed in air circulation systems, according to INT. The company has been developing BioDetect for the past two years.

A BioDetect prototype has been currently developed. The current system is the size of a shoe box and weighs about 20 pounds. Within a year, INT plans to make a hand-held version, which also could be used in hospitals or doctor's offices.

The BioDetect system is based on the electronic detection of DNA binding on a computer chip. Using the Technion technology, INT developed a method for coating DNA with metal to make it a conductive wire. First, DNA probes are placed on a computer chip. Air, liquid or solid samples are passed over the chip. If there is a match, the sample DNA binds with the DNA probe.

The metal coating then is introduced to the system. Where there is a match, the DNA creates a bridge between electrodes. The metal coats the DNA bridge and conducts the charge between the electrodes. The connection is detected by the chip, identifying the sample and producing results within 30 minutes.

For the purposes of the present invention, the BioDetect system can be used to detect the presence of viruses hidden inside one of the cargo containers that cause illnesses.

Referring still to FIG. 3, in one additional embodiment of the present invention, the block 60 for detecting at least one threat signature by detecting an exchange of matter of at least one threat with its surroundings further comprises a fungi detector 84.

An improved method for direct fungal identification and enumeration in air and surface samples was developed for use at the Department of Energy's Savannah River Site (SRS), Aiken, S.C. Direct microscopic examination of fungal hyphae and conidia is often difficult for indoor samples due to debris, including pollen and fluorescent textile fibers. Therefore, a staining method incorporating FUN-1 (Molecular Probes, Eugene, Oreg.), Fluorescent Brightener 28 (Sigma Chemical Co., St. Louis, Mo.), and potassium hydroxide was developed to directly examine microorganisms in air and physical samples. The sampling included environmental samples from several buildings using the Andersen 6-Stage Viable Particle-Sizing Air Sampler (Smyrna, Ga.), and direct surface sampling where fungal growth was suspected. Split samples showed the new staining method was more effective in detecting and distinguishing fungal structures collected during sampling and also enhanced clarity of structures of fungal isolates. Application of this technique has increased the speed and sensitivity of fungi detection for workspace monitoring. This method was applied to workspace assessments and has increased understanding of the relationships between fungal growth on surfaces, airborne fungi, environmental factors and overall workspace assessment.

The improved method for direct fungal identification disclosed above can be used for the purposes of the present invention, to detect the presence of fungi contamination inside a container while in transit.

Referring still to FIG. 3, in one embodiment of the present invention, the block 60 further comprises: a life object detector 86 configured to detect a live object selected from the group consisting of: {a human body; an animal body; a plant; and an insect}.

For the purposes of the present invention, the life detector 86 can be implemented by using a computer vision techniques that incorporate physical motion analysis and object behavior recognition. The objective of the physical motion analysis is to measure the physical object motion in the scene, wherein a temporal sequence of object positions, poses, and shapes are computed.

The objective of an object behavior recognition is to determine a common pattern of an object physical motions constrained by innate properties of an object and/or by its surrounding environments, so that the following patterns of the physical objects can be recognized: incoming and outgoing from a door, walking, running, bowing.

The single object detection and tracking can be performed by a single observation station. In the prototype system, each observation station is equipped with an APS camera (implemented by SONY EVI-G20). The APS camera first generates a panoramic background image of the scene. Then, it conducts the subtraction between a live input video image and its corresponding background sub-image. Analyzing the subtracted image, objects can be detected as anomalous regions and the camera parameters are controlled to track and focus on the target object. Experiments in the real world scene demonstrated practical utilities and efficiency of the APS camera.

A system has been also developed to recognize an object behavior by a fixed APS camera. In the object model learning phase, a temporal sequence of anomalous regions are extracted by applying the background subtraction to input video images. Then, the system constructs a non-deterministic finite automaton (NFA) model from a set of such sequences representing the same object behavior (e.g. entering a door). Each state of NFA represents an intermediate stage of the behavior and records a focusing region to verify if an object in a current input image stays at that stage. If it is verified, that state is activated. When such state activation is propagated to the final state, the system recognizes the object behavior represented by the NFA model. By using a group of NFA models representing different object behaviors, one can classify the object behavior captured by a video camera.

For the purposes of the present invention, different live objects: {a human body; an animal body; a plant; and an insect} hidden inside a container can be observed and recognized by using the computer vision techniques disclosed above as soon as each such live object has his/its own distinct behavior pattern.

For example, a human intruder hidden inside a container can be detected when he starts to move, etc. Of course, the detection of a human intruder is the most important function of such live detector.

Referring still to FIG. 1, in one embodiment of the present invention, some functions of the block 12 for detecting at least one threat signature by detecting an exchange of energy and/or matter of at least one threat with its surroundings can be implemented by using an electrical sensor configured to produce an output electrical signal based on the detected exchange of energy and/or matter of at least one threat with its surroundings for further sensor fusion processing by a standard computer. Please, see discussion below.

However, if an optical computer can be used in the future for sensor fusion processing of some of the detected signals, the corresponding detectors could be configured to output an optical signal.

In addition, the acoustical sensor could be configured to produce an output acoustical signal based on the detected exchange of energy and/or matter of at least one threat with its surroundings.

Figure 3A:
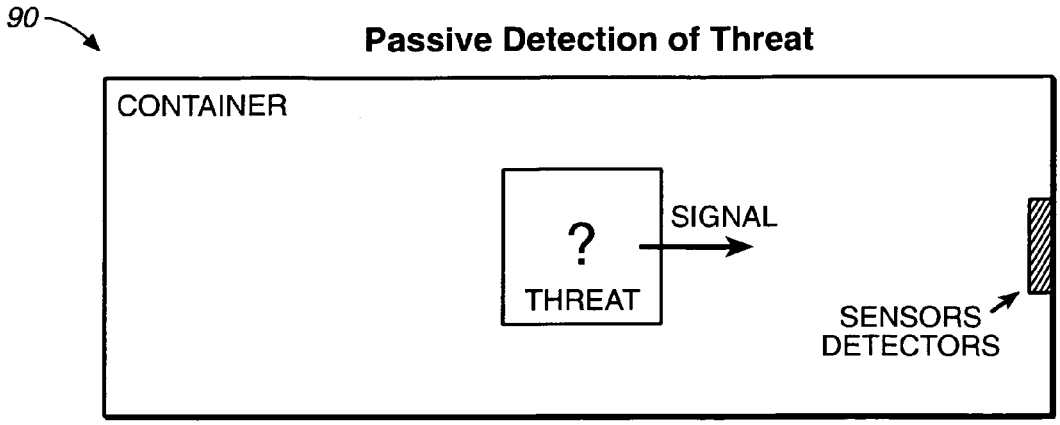
FIG. 3A illustrates a passive detection of threat.
Figure 3B:
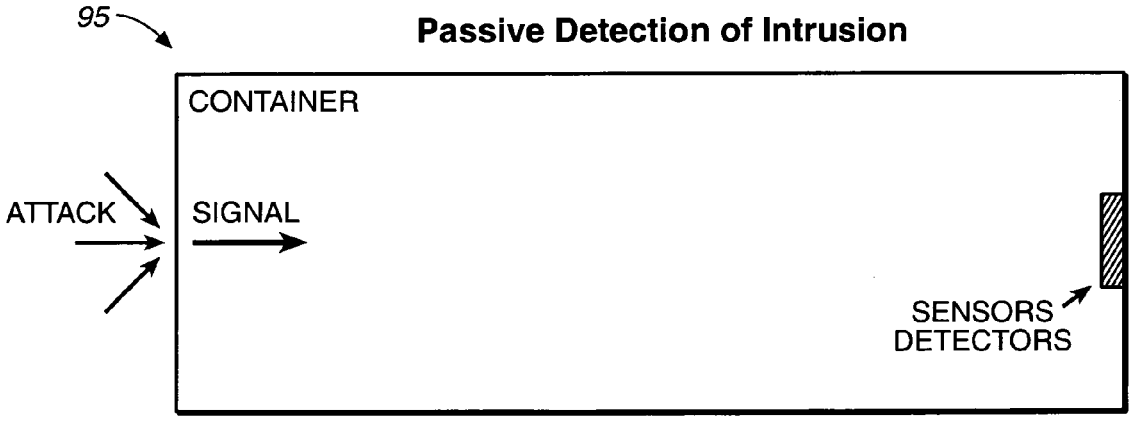
FIG. 3B is an illustration of a passive detection of intrusion.
Figure 4A:
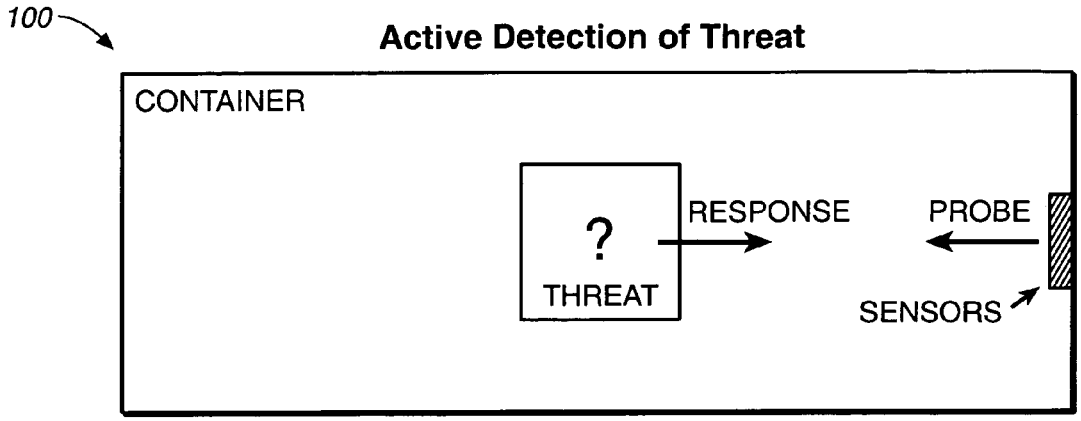
FIG. 4A illustrates an active detection of threat.
Figure 4B:
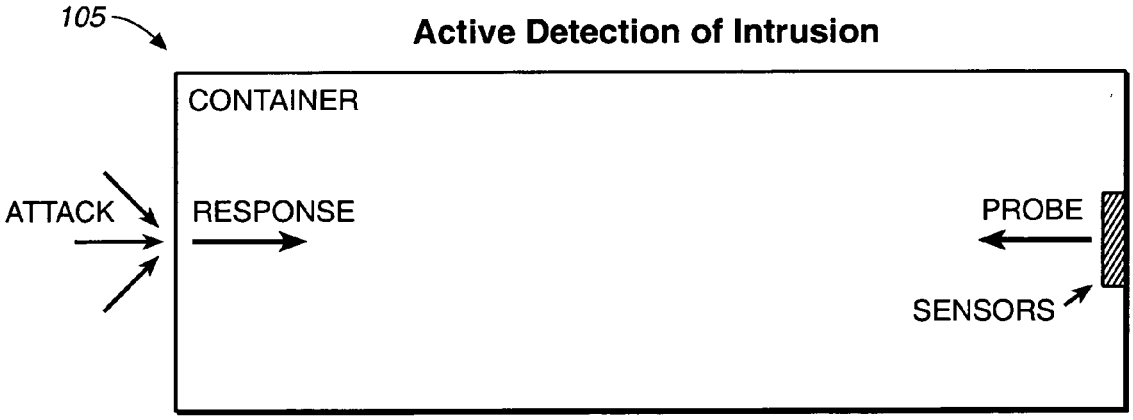
FIG. 4B is an illustration of an active detection of intrusion.

All detectors disclosed above are considered to be passive detectors, as illustrated in FIGS. 3A–3B, or active detectors, as illustrated in FIGS. 4A–4B.

The Risk Tables that illustrate various threats are given in Appendix. Risk Tables 1 and 2 include four broad categories of threats: chemical, biological, nuclear, and living. Chemical threats comprise explosives and poisons. Examples of explosives include ammonium nitrate and fuel oil (ANFO), TNT, C-4 and RDX. Examples of poisons include Sarin, Ricin, cyanide and VX. Biological threats comprise bacteria, viruses and fungi. Examples of bacterial threats include anthrax, botulin and plague. Examples of viral threats include small pox and Ebola. Nuclear threats comprise so-called "dirty" bombs and uranium- and plutonium-based weapons. Examples of dirty bombs include Co-60 or Cs-137 packaged with an explosive. Examples of uranium- and plutonium-based weapons include both atomic and nuclear devices. Uranium and plutonium are also toxic, radioactive elements. In combination with an explosive, they could also be classified as a chemical poison, as well as a dirty bomb. Living threats comprise plants animals and people. Examples of living threats include terrorists, and conceivably insects. Some of the above threats might also be classified as weapons of mass destruction (WMDs). Creating a special class of threats labeled WMDs is not particularly useful, because much depends on how they are built and deployed. The proposed schemed has the advantage of making it easier to link a given threat with a potential signature or suite of signatures.

As defined herein, attacks are attempts to violate the integrity of a container. Risk Tables 3 and 4 (please, see Appendix) incldue three types of attack: tampering, breaching, and intrusion. Tampering refers to attacks that do not penetrate the container. Breaching refers to attacks that do penetrate the container but create an opening less than nine square-inches. Intrusion refers to attacks that create an opening greater than or equal to nine square-inches, whether or not anything is placed within the container. All three types of attacks are considered significant security violations and need to be detected and reported.

If a signal produced by a detected threat signature is measured many times, the individual measurements will cluster about some average value. The average value of the detected threat signature may or may not be well known. In fact, it may only be approximately known, or it may even change with time. For the purposes of the present invention, however, it is only necessary that the average value of the detected threat signature varies slowly with respect to the interval between measurements. The time scale will depend on the particular source of the threat signature being measured.

Typically, any given measurement differs from the average value associated with the signal being measured. This deviation from the average may be due to systematic error or random statistical fluctuation. Systematic errors bias all measurements, including the average. This bias affects the accuracy of the measurements but is not particularly troublesome because it is possible to compensate for systematic bias.

Statistical fluctuations are more basic. They can be minimized but not eliminated. The inherent uncertainty associated with the measurement of any variable exists even at the quantum level. Thus, an ensemble of measurements is needed to produce a spread of values. If the number of occurrences of each measured value is plotted against the value, the result is a histogram. The histogram is generally peaked around the average value and tails off on either side thus representing a real distribution of the values of a variable being measured.

A distribution, standard or otherwise, can be characterized in terms of its moments. The first moment is called the mean. This is just the average value of the distribution. The second moment is called the variance. This is a figure of merit that characterizes the spread of the distribution. The larger the variance, the broader the distribution. Higher-order moments characterize other properties of the histogram.

When no threat is present, a series of measurements made on the ambient environment will produce some distribution of values. The mean and standard deviation of this baseline distribution can be thought of as the background against which a threat should be detected. In the absence of statistical fluctuations, any threat, no matter however weak, can be differentiated from the background. However, statistical fluctuations cannot be eliminated from the measurement process. Therefore, threat signals should be identified by detecting statistically significant deviations from the average.

Figure 4C:
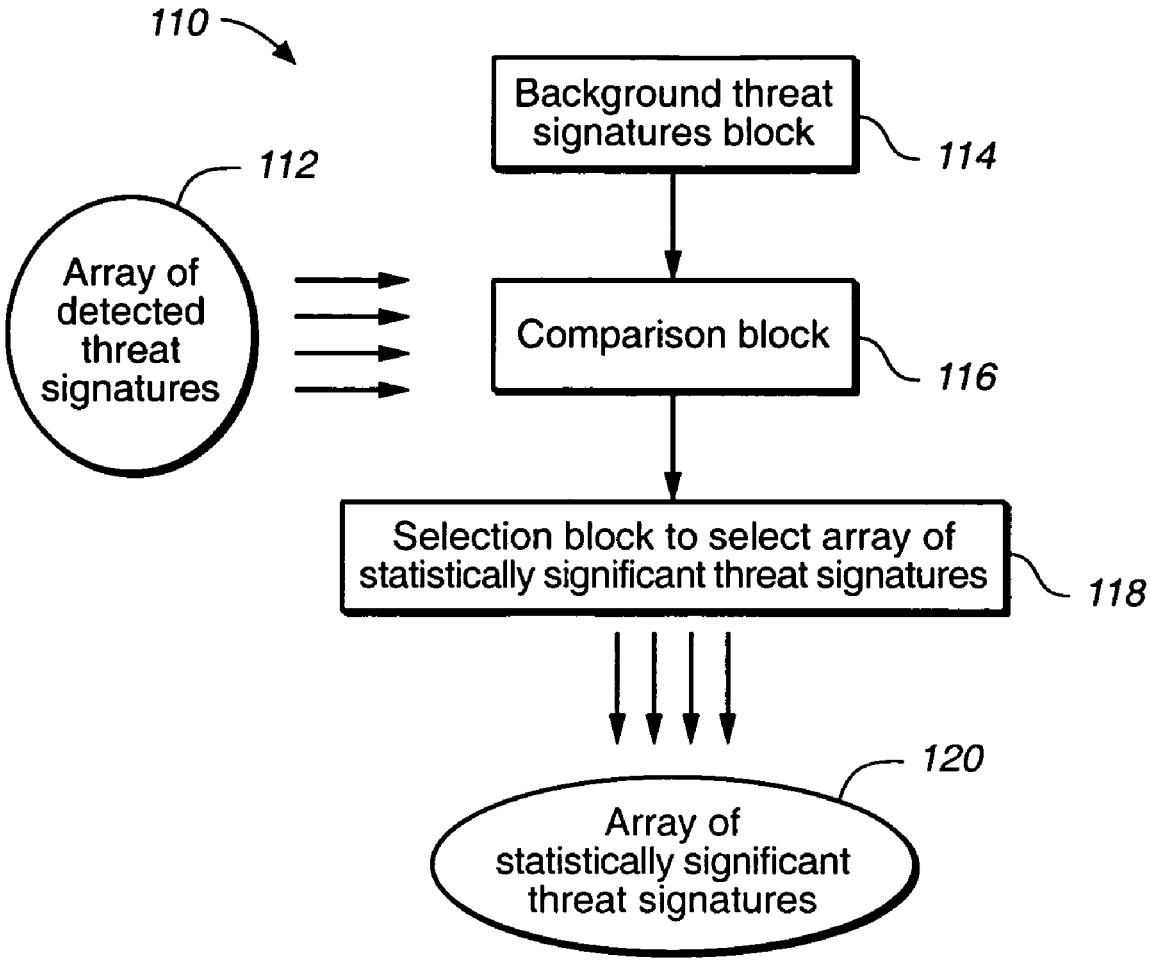
FIG. 4C depicts the block for selecting an array of statistically significant threat signatures.

In one embodiment of the present invention, FIG. 4C depicts the block 110 for selecting an array of statistically significant threat signatures further comprising a block 114 configured to for measure a background threat signature distribution in a threat-free environment, a block 116 configured to compare each detected threat signature signal 112 with the background threat signature distribution; and a block 118 configured to select the detected threat signature to be a part of the array 120 of the statistically significant detected threat signatures for further processing, if deviation of the detected threat signature signal from the background threat signature distribution is statistically significant.

At the simplest level, the detection task is a two-step process: (1) some value between the known distribution of background measurements and the distribution of chosen threat signals is picked as the critical value; and (2) if a given measurement falls to a predetermined side of this critical value, it is classified as a threat; if it falls to the opposite side, it is classified as background.

If the threat signal is assumed to be strong, its average will lie from the average of the background. Even in the presence of statistical fluctuations, threat signals will typically fall far from any background signals. In this case, the critical value can be chosen almost somewhere between the two distributions, and the chance of misidentifying one or the other will be small.

On the other hand, if the threat signal is assumed to be weak, its average will lie close to the average of the background. In the presence of statistical fluctuations, threat signals will overlap background signals. In this case, no matter what critical value is chosen, some threat signals will be classified as background (referred to as false negatives) and some background signals will be classified as threats (referred to as false positives). Depending on the choice of critical value, the relative numbers of false negative and false positives can vary substantially.

Thus, referring still to FIG. 4C, the selection for further processing in block 118 of statistically significant threat signatures that statistically significantly deviate from the background threat signature distribution ensures the minimization of both false negative threat signatures and false positives threat signatures.

However, with a single sensor modality operating close to the threshold of detection, a low false negative rate necessarily entails a high false positive rate; and vice versa. A high rate of false negatives can have serious security consequences; a high rate of false positives can have serious economic consequences. Ideally, both rates should be low. One way around this dilemma is to use multiple sensor modalities to search for threats.

Figure 5:
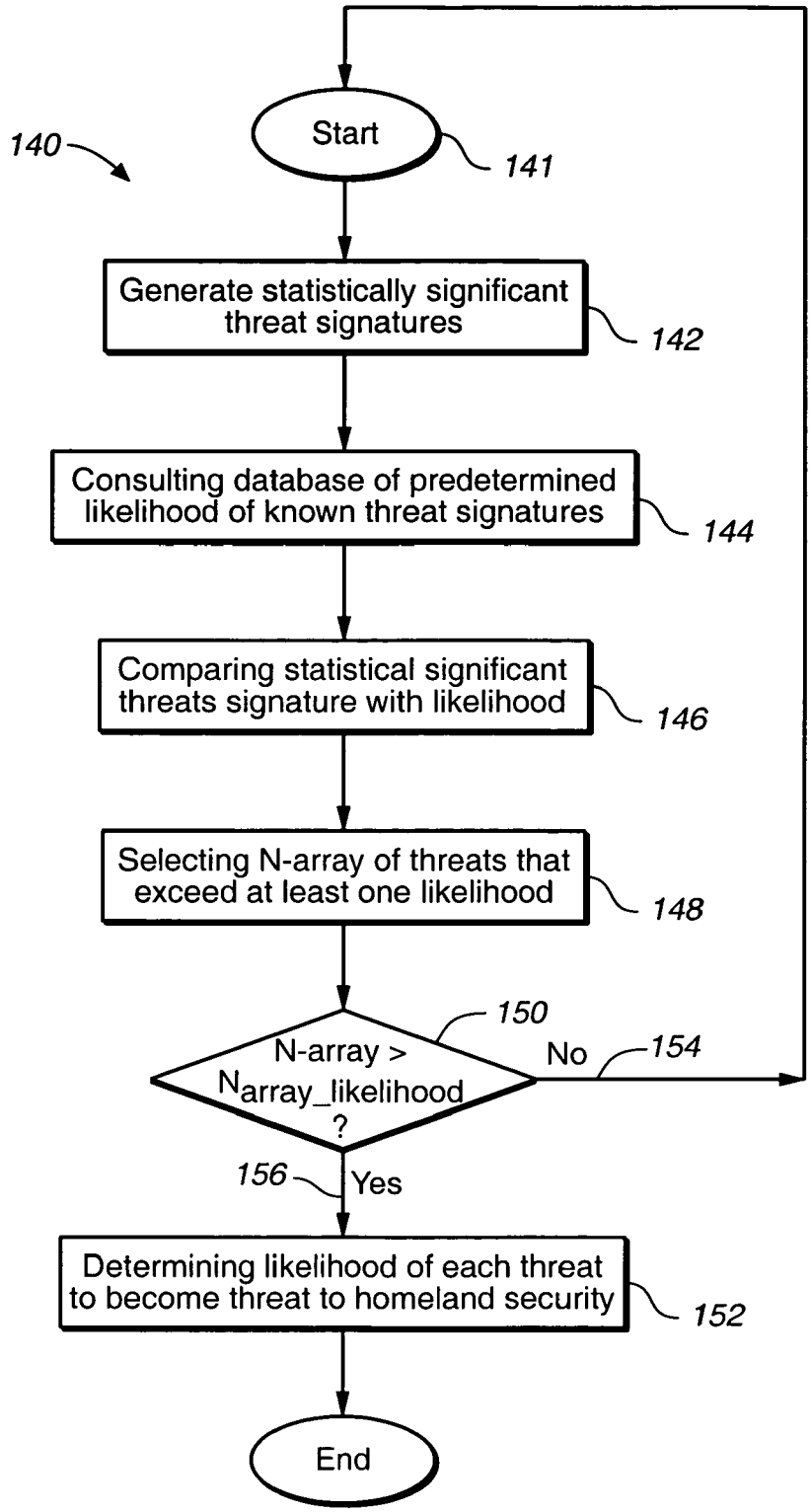
FIG. 5 illustrates the block for substantially continuously processing the array of the selected statistically significant threat signatures.

Thus, in one embodiment of the present invention, FIG. 5 illustrates the block 140 for substantially continuously processing the array of the selected statistically significant threat signatures (120 of FIG. 4C) further comprising: a block 142 for generating a statistically significant threat signal corresponding to each detected threat signature having the statistically significant deviation from the background threat signature distribution; a block 144 for consulting a database of predetermined thresholds associated with a plurality of known threat signatures; a block 146 for comparing each statistically significant threat signature signal with at least one predetermined threshold associated with the plurality of known threat signatures; a block 148 for selecting each statistically significant threat signature signal that exceeds at least one predetermined threshold associated with the plurality of known threat signatures into an N-array of threat signatures; a test block 150 to determine if the number of threat signatures selected into an N-array is greater than $N_{array_thershold}$; and a block 152 for determining the likelihood of each threat generating at least one statistically significant threat signature signal exceeding at least one predetermined threshold to become a threat to the homeland security.

Referring still to FIG. 5, to decrease the low false negative rate and to decrease the high false positive rate, we use the idea os sensor fusion—we need a certain number N of statistically significant threat signature signals to exceed at least one predetermined threshold associated with the plurality of known threat signatures to be greater than $N_{array_thershold}$, before one should start the threat identification process in block 152 of FIG. 5.

The U.S. Pat. No. 5,051,723, issued to Long et al. and incorporated by reference herein in its entirety, discloses a self-contained theft and vandalism deterrent system for equipment security that includes a number of sensors for detecting conditions to which an alarm is responsive. The analog signals from the sensors are serially delivered by a multiplexer circuit when they are then directed to a network for conversion to digital signals. The digital signals are delivered to a microprocessor where the signals are evaluated to determine if an alarm condition exists. The sending means include sound and vibration detectors for monitoring the ambient envelope. The microprocessor includes built in reprogramming and comparator circuits for varying the levels at which a given condition will trigger an alarm response.

In one embodiment of the present invention, the block for processing the detected threat signals 14 of FIG. 1 can be implemented by using the developed in the '723 patent sensor ambient envelope processor.

More specifically, in one embodiment of the present invention, the block 140 comprises an Ambient Envelope Sensor-fusion (AES) platform of '723 patent that has a transparent open bus structure and accepts multiple sensor data stream inputs, interprets and interpolates the sensor data and outputs alarms, warnings and authorized requested data. In this embodiment, the AES platform provides for data fusion which uses multiple sets of data streams to significantly improve performance as compared with the situation when the same sensors are used separately. The AES platform can include a history record to develop an ambient envelop within each container.

EXAMPLE I

Detection of a Person Hidden Inside a Cargo Container. $N \geqq N_{array_thershold}=2$.

Assume that the primary detection modality is chosen to be acoustic, and the secondary detection modality is chosen to be chemical. In this scenario, an acoustic detector continuously monitors the cargo container for abnormal sounds. It is trained to recognize the normal sounds of a cargo vessel: thrumming engines, pounding waves, banging containers, shifting contents, etc. Operating close to its threshold of detection, it frequently "hears" scrapping noises that could be associated with human activity. Without other evidence, the perceived threat would be wrong an unacceptable percentage of the time. However, whenever such a "potential" threat is detected, there is one more detector to be consulted with—a methane detector. The methane detector also continuously monitors the cargo container for abnormal methane levels. It is trained to recognize natural levels of methane from decaying organic matter, mold, food products, fertilizer, etc. It is also operates at the threshold level of detection, and it frequently registers methane levels that could be associated with a human presence. Again, without other evidence, the perceived threat would be wrong much of the time. In the absence of a threat simultaneously reported by both the acoustic sensor and the methane detector, the apparatus 10 (of FIG. 1) of the present invention simply updates its data base and resets itself, thereby minimizing the false positive rate while maintaining a high degree of sensitivity to threats. However, if both detectors are detecting the threat signatures to be above their corresponding thresholds, the threat inside container is identified as a hidden human intruder.

It should be noted, though, that in the given above example the assumption is that the acoustic signal and the methane signal overlap in time. To get rid of this limitation, we need to increase the number of N of threat signatures in N-array, that is we need to select another detector and deal with at least three threat signatures each of which exceeds corresponding threshold: $N \geqq N_{array_thershold}=3$.

EXAMPLE II

Detection of a Dirty Bomb Hidden Inside a Cargo Container. $N \geqq N_{array_thershold}=1$.

The radioactive materials of choice are likely to be isotopes of cesium (Cs-137) and cobalt (Co-60). They have high activity levels, generate lethal amounts of radiation, and are commercially available. Since the radiation is fairly penetrating, a radiation sensor left alone in a sealed container for a period of time with a dirty bomb has a reasonable chance of detecting abnormal levels of radiation. If the detector can make energy-selective measurements, even if they are rather crude in their energy discrimination, the chances of detection increase significantly. In the event an alarm is generated, the apparatus 10 (of FIG. 1) of the present invention hardly needs to consult another sensor for confirmation. The detection of a corroborating signal would be nice but is probably unnecessary if a positive signal is detected by the radiation sensor alone.

Clearly, there are tradeoffs to be made in terms of the number of sensors-modalities to be used, the choice of modalities, the sophistication (think cost) of the measurements, the perceived likelihood of a threat, the acceptable false positive rate, the acceptable false negative rate, etc.

In operation, the apparatus of the present invention 10 of FIG. 1 performs the following basic steps (not shown): (A) detecting at least one threat signature; and (B) processing each detected threat signature to determine a likelihood of at least one threat to become a threat to the homeland security.

In one embodiment of the present invention, the step (A) of detecting at least one threat signature further comprises the step (A1) of detecting each threat signature by detecting exchange of energy and/or matter of the threat with its surroundings.

More specifically, in one embodiment of the present invention, the step (A1) of detecting at least one threat signature by detecting an exchange of energy and/or matter of at least one threat with its surroundings further comprises (not shown) the step (A1, 1) of detecting a form of exchanged energy selected from the group consisting of: {kinetic energy; and electromagnetic energy}. In this embodiment of the present invention, the kinetic energy is further selected from the group consisting of: {vibrational; thermal; and mechanical stored energy}; the vibrational energy is further selected from the group consisting of: {audible acoustic energy; and inaudible acoustic energy}; the thermal energy is further selected from the group consisting of: {conductive heat transfer; and convective heat transfer}; the mechanical stored energy is further selected from the group consisting of: {pressure stored energy; stress stored energy; tension tensile stored energy; and tension compressive stored energy}; and the electromagnetic energy (EM) is further selected from the group consisting of: {infrared (IR) electromagnetic energy (EM), visible (VIS) spectrum electromagnetic energy (EM); ultraviolet (UV) electromagnetic energy (EM); radio frequency (RF) electromagnetic energy (EM); X-ray electromagnetic energy (EM); and γ-ray electromagnetic energy (EM)}.

In one embodiment of the present invention, the step (A1) of detecting at least one threat signature by detecting exchange of energy and/or matter of at least one threat with its surroundings further comprises (not shown) the step (A1, 2) of detecting an exchange of matter of the threat with its surroundings by detecting particles selected from the group consisting of: {subatomic particles; elements; molecules; and life forms}. In this embodiment of the present invention, the subatomic particles are further selected from the group consisting of: {alpha particles (helium nuclei); beta particles (electrons and positrons); and neutrons}; the elements are further selected from the group consisting of: {neutral atoms; ionized atoms; stable isotopes; and unstable isotopes}; the molecules are further selected from the group consisting of: {inorganic molecules; and organic molecules}; and the life forms are further selected from the group consisting of: {bacteria; viruses; and fungi}.

In one embodiment of the present invention, the step (A1) of detecting at least one threat signature by detecting an exchange of energy and/or matter of at least one threat with its surroundings (not shown) further comprises the step (A1, 3) of detecting an exchange of energy and/or matter of the threat with its surroundings by detecting a live object selected from the group consisting of: {a human body; an animal body; a plant; and an insect}.

In one embodiment of the present invention, the step (A1) of detecting at least one threat signature by detecting exchange of energy and/or matter of at least one threat with its surroundings (not shown) further comprises the step (A1, 4) of using a sensor configured to produce an output signal based on the detected exchange of energy and/or matter of at least one threat with its surroundings. In one embodiment of the present invention, the sensor comprises a sensor configured to produce an electrical output signal based on the detected exchange of energy and/or matter of at least one threat with its surroundings. In another embodiment of the present invention, the sensor comprises a sensor configured to produce an optical output signal based on the detected exchange of energy and/or matter of at least one threat with its surroundings. In an additional embodiment of the present invention, the sensor comprises a sensor configured to produce an acoustical output signal based on the detected exchange of energy and/or matter of at least one threat with its surroundings.

In one embodiment of the present invention, the step (A1) of detecting at least one threat signature by detecting exchange of energy and/or matter of at least one threat with its surroundings further comprises the step of using at least one sensor to substantially continuously monitor an interior environment of at least one cargo container to detect at least one threat signature.

In one embodiment of the present invention, the step (B) of processing each detected threat signature further comprises (not shown) the following steps: (B1) selecting an array of statistically significant detected threat signatures; and (B2) substantially continuously processing the array of the selected statistically significant threat signatures in order to determine the likelihood of each threat.

In one embodiment of the present invention, the step (B1) of selecting the array of statistically significant detected threat signatures further comprises (not shown) the following steps: (B1, 1) measuring a background threat signature distribution in a threat-free environment; (B1, 2) comparing each detected threat signature signal with the background threat signature distribution; and (B1, 3) if deviation of the detected threat signature signal from the background threat signature distribution is statistically significant, selecting the detected threat signature to be a part of the array of the selected statistically significant threat signatures.

In one embodiment of the present invention, the step (B2) of substantially continuously processing the array of the selected statistically significant threat signatures in order to determine the likelihood of each threat further comprises the following steps, shown in the chart 140 of FIG. 5: (step 142) generating a statistically significant threat signal corresponding to each detected threat signature having the statistically significant deviation from the background threat signature distribution; (step 144) consulting a database of predetermined thresholds associated with a plurality of known threat signatures; (step 146) comparing each statistically significant threat signature signal with at least one predetermined threshold associated with the plurality of known threat signatures; (step 148) selecting each statistically significant threat signature signal that exceeds at least one predetermined threshold associated with the plurality of known threat signatures into an N-array of threat signatures, wherein the N-array of threat signatures includes an integer number N of statistically significant threat signature signals exceeding at least one predetermined threshold; (test condition 150) if the integer number N of statistically significant threat signature signals exceeding at least one predetermined threshold and selected into the N-array exceeds a predetermined number $N_{array_threshold}$; (step 152) determining the likelihood of each threat generating at least one statistically significant threat signature signal exceeding at least one predetermined threshold and selected into the N-array; and (B2, 6) if the likelihood of at least one threat determined in the step (152) exceeds a predetermined threshold, identifying each threat as a threat to the homeland security (not shown).

The foregoing description of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. Therefore, it is intended that the scope of the invention be defined by the claims appended hereto and their equivalents, rather than by the foregoing description. All changes which come within the meaning and range of equivalency of the claims are to be embraced within their scope.

APPENDIX

Risk Tables

| | | Threat | | | | | | | | | | |
|---|---|---|---|---|---|---|---|---|---|---|---|---|
| | | Chemical | | Biological | | | Nuclear | | | Living | | |
| | | Explosive | Poison | Bacteria | Virus | Fungus | Dirty | Uranium | Plutonium | Plant | Animal | Person |
| | | Examples | | Examples | | | Examples | | | Examples | | |
| | | ANFO | Sarin | Anthrax | Small Pox | | Co Bomb | Uranium | Plutonium | | Insect | Terrorist |
| | | TNT | OsO4 | Botullin | Ebola | | Cs Bomb | | | | | Stow-away |
| | | C-4 | Ricin | Plague | | | | | | | | |
| Modality Signature | Examples | RDX | Cyanide VX | | | | | | | | | |
| Energy | | | | | | | | | | | | |
| Mechanical | | | | | | | | | | | | |
| Acoustic | Noise, Vibration | 1 | 1 | 1 | 1 | | 1 | 1 | 1 | | | 9 |
| Thermal | Conductive Heat | | | | | | | | | | | |
| Force | Pressure, Stress | 1 | 1 | 1 | 1 | | 1 | 1 | 1 | | | |
| Electromagnetic | | | | | | | | | | | | |
| IR | Radiative | 1 | 1 | 1 | 1 | | 1 | 1 | 1 | | 7 | 7 |
| VIS | Sight | | | | | | | | | | | 8 |
| UV | UV Emission | | | | | | | | | | | |
| RF | RF Emission | 4 | 4 | 4 | 4 | | 4 | 4 | 4 | | | |
| X ray | X ray Emission | | | | | | 3 | (3) | 3 | | | |
| γ ray | γ ray Emission | | | | | | 3 | (3) | 3 | | | |
| Mass | | | | | | | | | | | | |
| Subatomic | α, β, n | | | | | | 3 | (3) | 3 | | | |
| Elemental | O2, N2, H+ | | | | | | | | | 2 | 2 | 2 |
| Inorganic | NOX, CO—, AN | 5 | 5 | 5 | 5 | 5 | 5 | 5 | 5 | 2 | 2 | 2 |
| Organic | CH4, C-4, Protein | 6 | 6 | 6 | 6 | 6 | 6 | 6 | 6 | 2 | 2 | 2 |
| Biological | Bacteria, Virus | | | 2 | 2 | 2 | | | | 2 | 2 | 2 |

Item:

1 Weapons often contain explosives. If a device explodes prematurely, multiple types of acoustic, IR and pressure sensors.
2 Living objects exchange inorganic and organic material. Multiple types of gas and chemical sensors, as well as microfluidic devices and gas/mass spectrometers.
3 Dirty and Plutonium bombs emit radiations. Multiple sensors for neutrons, X rays and $\gamma^L$
4 Explosive devices may contain a timer. If a timer includes a microprocessor, multiple types of receivers for RF emissions.
5 Explosives may release trace inorganic materials. Multiple types of gas and chemical sensors, as well as microfluidic devices and gas/mass spectrometers.
6 Explosives may release trace organic materials. Multiple types of gas and chemical sensors, as well as microfluidic devices and gas/mass spectrometers.
7 Animals radiate heat. Multiple types of IR sensors.
8 Cameras can visually monitor the interior. Multiple types of cameras.
9 Activities generate sound. Multiple types of acousting sensors.

TABLE 2

ACTIVE DETECTION OF THREATS

| | | Threat | | | | | | | | | | |
|---|---|---|---|---|---|---|---|---|---|---|---|---|
| | | Chemical | | Biological | | | Nuclear | | | Living | | |
| | | Explosive | Poison | Bacteria | Virus | Fungus | Dirty | Uranium | Plutonium | Plant | Animal | Person |
| | | Examples | | Examples | | | Examples | | | Examples | | |
| Modality Signature | Examples | ANFO<br>TNT<br>C-4<br>RDX | Sarin<br>OsO4<br>Ricin<br>Cyanide<br>VX | Anthrax<br>Botullin<br>Plague | Small Pox<br>Ebola | | Co Bomb<br>Cs Bomb | Uranium | Plutonium | | Insect | Terrorist<br>Stow-away |
| Energy | | | | | | | | | | | | |
| Mechanical | | | | | | | | | | | | |
| Acoustic | Noise, Vibration | | | | | | | | | | | 1 |
| Thermal | Conductive Heat | | | | | | | | | | | |
| Force | Pressure, Stress | | | | | | | | | | | |
| Electromagnetic | | | | | | | | | | | | |
| IR | Radiative Heat | | | | | | | | | | | |
| VIS | Sight | | | | | | | | | | | 4 |
| UV | UV Emission | | | | | | | | | | | |
| RF | RF Emission | 3 | 3 | 3 | 3 | | 3 | | | | | |
| X ray | X ray Emission | | | | | | | | | | | |
| L | L | | | | | | | | | | | |
| Subatomic | L | 2 | 2 | 2 | 2 | | 2 | 2 | 2 | | | |
| Elemental | O2, N2, H+ | | | | | | | | | | | |
| Inorganic | NOX, CO—, AN | | | | | | | | | | | |
| Organic | CH4, C-4, Protein | | | | | | | | | | | |
| Biological | Bacteria, Virus | | | | | | | | | | | |

Item:

1 Probe for people or objects being moved around. Signature is anomalous echo. Multiple sensors.
2 Probe for explosives with high-energy X rays or $\gamma^L$
3 Probe for timer based on ID-tag technology with RF. Signature is RF reply. Multiple receivers.
4 Watch for people or objects being moved around. Signature is any movement. Multiple motion detection schemes.

TABLE 3

PASSIVE DETECTION OF ATTACKS

| | | Attack | | |
|---|---|---|---|---|
| | | Tampering Examples | Breach Examples | Intrusion Examples |
| | | Attempt to Breach Container | Penetrate Walls, Floor, or Ceiling<br>Insert Gas/Liquid Via Hose | Enter Container<br>Insert Object into Container |
| Modality Signature | Examples | | | |
| Energy | | | | |
| Mechanical | | | | |
| Acoustic | Noise, Vibration | 1 | 1, 4 | 1, 4 |
| Thermal | Conductive Heat | | | |
| Force | Pressure, Stress | 2 | 2, 4 | 2, 4 |
| Electromagnetic | | | | |
| IR | Radiative Heat | 2 | 2, 3, 4 | 2, 3, 4 |
| VIS | Sight | | 3, 4 | 3, 4 |

TABLE 3-continued

| | | | |
|---|---|---|---|
| UV | UV Emission | 3 | 3 |
| RF | RF Emission | 4 | 4 |
| X ray | X ray Emission | 4 | 4 |
| γ ρα | γ ραψ Εμισσισν | 4 | 4 |
| Mass | | | |
| Subatomic | L | 4 | 4 |
| Elemental | O2, N2, H+ | 4 | 4 |
| Inorganic | NOX, CO—, AN | 4 | 4 |
| Organic | CH4, C-4, Protein | 4 | 4 |
| Biological | Bacteria, Virus | 4 | 4 |

Item:

1 Drilling, prying, cutting (mechanical and welding torch), denotating, etc. generate sound. Multiple types of acoustic sensors.
2 Welding torches generate heat and explosive devices generate heat and pressure. Multiple types of temperature and pressure sensors.
3 If the container is breached, various electromagnetic signatures possible. Multiple types of cameras.
4 Once a threat is inside the container, all items in Table 1 apply.

TABLE 4

ACTIVE DETECTION OF ATTACKS

| | | Attack | | |
|---|---|---|---|---|
| | | Tampering Examples | Breach Examples | Intrusion Examples |
| | | Attempt to Breach Container | Penetrate Walls, Floor, or Ceiling<br>Insert Gas/Liquid Via Hose | Enter Container<br>Insert Object into Container |
| Modality Signature | Examples | | | |
| Energy Mechanical | | | | |
| Acoustic | Noise, Vibration | | 1 | 1 |
| Thermal | Conductive Heat | | | |
| Force | Pressure, Stress | | | |
| Electromagnetic | | | | |
| IR | Radiative Heat | | | |
| VIS | Sight | | | |
| UV | UV Emission | | | |
| RF | RF Emission | | | |
| X ray | X ray Emission | | | |
| γ ραψ | γ ραψ Εμισσισν | | | |
| Mass | | | | |
| Subatomic | α, β, ν | | | |
| Elemental | O2, N2, H+ | | | |
| Inorganic | NOX, CO—, AN | | | |
| Organic | CH4, C-4, Protein | | | |
| Biological | Bacteria, Virus | | | |

Item:

1 Probe for people or objects being moved around. Signature is anomalous echo. Multiple sensors.

What is claimed is:

1. A method for identifying at least one threat to homeland security; each said threat either being hidden inside at least one cargo container before transit, or being placed inside at least one cargo container while in transit; each said threat while interacting with its surroundings generates a unique threat signature; said method comprising the steps of:

(A) detecting at least one threat signature;

(B1, 1) measuring a background threat signature distribution in a threat-free environment;

(B1, 2) comparing each said detected threat signature with said background threat signature distribution;

(B1, 3) if deviation of said detected threat signature from said background threat signature distribution is statistically significant, selecting said detected threat signature to be a part of an array of statistically significant detected threat signatures;

and (B2) substantially continuously processing said array of selected statistically significant detected threat signatures in order to determine a likelihood of each said threat.

2. A method for identifying at least one threat to homeland security; each said threat either being hidden inside at least one cargo container before transit, or being placed inside at least one cargo container while in transit; each said threat while interacting with its surroundings generates a unique threat signature; said method comprising the steps of:

(A) detecting at least one threat signature;

(B1) selecting an array of statistically significant detected threat signatures;

(B2, 1) generating a statistically significant threat signature signal corresponding to each said detected threat signature having a statistically significant deviation from a background threat signature distribution;

(B2, 2) consulting a database of predetermined thresholds associated with a plurality of known threat signatures;

(B2, 3) comparing each said statistically significant threat signature signal with at least one said predetermined threshold associated with said plurality of known threat signatures;

(B2, 4) selecting each said statistically significant threat signature signal exceeding at least one said predetermined threshold associated with said plurality of known threat signatures into an N-array of threat signatures, N being an integer;

(B2, 5) if said integer number N of statistically significant threat signatures signals exceeds a predetermined number $N_{array_threshold}$, determining a likelihood of each said threat generating at least one said statistically significant threat signature signal exceeding at least one said predetermined threshold;

and (B2, 6) if said likelihood of at least one of said threats determined in said step (B2, 5) exceeds a predetermined likelihood threshold, identifying each said threat as a threat to homeland security.

3. An apparatus for identifying at least one threat to homeland security; each said threat either being hidden inside at least one cargo container before transit, or being placed inside at least one cargo container while in transit; each said threat while interacting with its surroundings generates a unique threat signature; said apparatus comprising:

(A1) a means for detecting at least one threat signature by detecting exchange of energy and/or matter of one said threat with its surroundings;

(B1, 1) a means for measuring a background threat signature distribution in a threat-free environment;

(B1, 2) a means for comparing each said detected threat signature with said background threat signature distribution;

(B1, 3) a means for selecting each said detected threat signature to be a part of an array of statistically significant detected threat signatures, if deviation of each said selected threat signature from said background threat signature distribution is statistically significant;

and (B2) a means for substantially continuously processing said array of selected statistically significant detected threat signatures in order to determine a likelihood of each said threat.

4. An apparatus for identifying at least one threat to homeland security; each said threat either being hidden inside at least one cargo container before transit, or being placed inside at least one cargo container while in transit; each said threat while interacting with its surroundings generates a unique threat signature; said apparatus comprising:

(A1) a means for detecting at least one threat signature by detecting exchange of energy and/or matter of one said threat with its surroundings;

(B1) a means for selecting an array of statistically significant detected threat signatures;

(B2, 1) a means for generating a statistically significant threat signature signal corresponding to each said detected threat signature having a statistically significant deviation from a background threat signature distribution;

(B2, 2) a means for consulting a database of predetermined thresholds associated with a plurality of known threat signatures;

(B2, 3) a means for comparing each said statistically significant threat signature signal with at least one said predetermined threshold associated with said plurality of known threat signatures;

(B2, 4) a means for selecting each said statistically significant threat signature signal exceeding at least one said predetermined threshold associated with said plurality of known threat signatures into an N-array of threat signatures;

(B2, 5) a means for determining a likelihood of each said threat generating at least one said statistically significant threat signature signal exceeding at least one said predetermined threshold;

and (B2, 6) a means for identifying each threat having a likelihood of generating at least one said statistically significant threat signature signal exceeding a predetermined likelihood threshold as a threat to homeland security.

* * * * *